US012578126B2

(12) United States Patent
Lu et al.

(10) Patent No.: US 12,578,126 B2
(45) Date of Patent: Mar. 17, 2026

(54) HYBRID EVAPORATIVE-RADIATIVE COOLING PANELS

(71) Applicant: Massachusetts Institute of Technology, Cambridge, MA (US)

(72) Inventors: Zhengmao Lu, Cambridge, MA (US); Arny Leroy, Montreal (CA); Evelyn N. Wang, Cambridge, MA (US); Jeffrey C. Grossman, Brookline, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 98 days.

(21) Appl. No.: 18/699,858

(22) PCT Filed: Oct. 26, 2022

(86) PCT No.: PCT/US2022/047947

§ 371 (c)(1),
(2) Date: Apr. 9, 2024

(87) PCT Pub. No.: WO2023/076435

PCT Pub. Date: May 4, 2023

(65) Prior Publication Data

US 2024/0418418 A1 Dec. 19, 2024

Related U.S. Application Data

(60) Provisional application No. 63/272,035, filed on Oct. 26, 2021.

(51) Int. Cl.
*F25B 25/00* (2006.01)
*F24F 5/00* (2006.01)
(Continued)

(52) U.S. Cl.
CPC ..... *F25B 25/00* (2013.01); *F25B 19/00* (2013.01); *F25B 23/003* (2013.01); *F25B 39/02* (2013.01); *F24F 5/0035* (2013.01)

(58) Field of Classification Search
CPC ..... F25B 25/00; F25B 19/00; F24F 5/0035; F24F 1/14; F24F 13/18
See application file for complete search history.

(56) References Cited

U.S. PATENT DOCUMENTS 9,034,934 B1 5/2015 Attia
2002/0073718 A1 6/2002 Maisotsenko et al.
(Continued)

FOREIGN PATENT DOCUMENTS

WO 2020072818 A1 4/2020
WO 2023076435 A1 5/2023

OTHER PUBLICATIONS

Rotzetter, A. C., et al. "Thermoresponsive polymer induced sweating surfaces as an efficient way to passively cool buildings." Advanced Materials (Deerfield Beach, Fla.) 24.39 (2012): 5352-5356.

(Continued)

*Primary Examiner* — Elizabeth J Martin
(74) *Attorney, Agent, or Firm* — Barnes & Thornburg LLP

(57) ABSTRACT

Hybrid evaporative and radiative cooling panel systems having increased cooling efficiency while minimizing water consumption are provided. The disclosed hybrid systems include a cooling panel that enables the improved cooling and water consumption via a reflector layer which reflects solar radiation, an evaporative and infrared-emitting layer that is solar-transparent and water-rich, and an insulation layer that is vapor-permeable, infrared-transparent, and solar-reflecting. The cooling panel is configured to be in fluid communication with a heat exchanger. The cooling panel is further configured to cool a heat transfer fluid by way of both evaporative cooling and radiative cooling. The cooling panel is also configured such that the heat transfer fluid passes at least one of through or across the cooling (Continued)

panel and flows to the heat exchanger. Various configurations of such panels and panel systems, and methods of implementing the principles associated with the same, are also disclosed.

21 Claims, 26 Drawing Sheets

(51) Int. Cl.

| | |
|---|---|
| ***F25B 19/00*** | (2006.01) |
| ***F25B 23/00*** | (2006.01) |
| ***F25B 39/02*** | (2006.01) |

(56) References Cited

U.S. PATENT DOCUMENTS

| | | | | |
|---|---|---|---|---|
| 2010/0018981 | A1 | 1/2010 | Hyde et al. | |
| 2015/0338175 | A1 | 11/2015 | Raman et al. | |
| 2016/0363396 | A1 | 12/2016 | Liu et al. | |
| 2020/0333047 | A1 | 10/2020 | Raman et al. | |
| 2024/0288200 | A1* | 8/2024 | Raman | F24S 70/60 |

OTHER PUBLICATIONS

Ruiz, et al., "Production cellular structure and thermal conductivity of microcellular ( methyl methacrylate )—( butyl acrylate )—( methyl methacrylate ) triblock copolymers," No. Oct. 2010, pp. 146-152, 2011.
Shah, Nihar, et al. "Benefits of leapfrogging to superefficiency and low global warming potential refrigerants in room air conditioning." (2015).
Solorzano, et al., Influence of Solid Phase Conductivity and Cellular Structure on the Heat Transfer Mechanisms of Cellular Materials: Diverse Case Studies** Adv Eng Mater 11(10) pp. 818-824, 2009.
Sickinger, et al., "Thermosyphon Cooler Hybrid System for Water Savings in an Energy-Efficient HPC Data Center: Modeling and Installation," Golden, CO, 2018.
SkyCool Systems Inc, "Using Sky Cooling to Increase Efficiency of Super Market Refrigeration Systems," Case Study: Super Market Refrigeration 2020.
"SkyCool Systems Inc, "Technology—SkyCool Systems," 2021. [Online]. Available: https://www.skycoolsystems.com/. Website archived in Jan. 2021 at https://web.archive.org/web/20210118002741/https://www.skycoolsystems.com/technology/".
Smith, "Note on the Relationship Between Total Precipitable Water and Surface Dew Point," J. Appl. Meteorol., vol. 5, No. 5, pp. 726-727, Oct. 1966.
Sonne, J.K., F. S. E. Center, D. S. Parker and S. F. Barkaszi Jr, Resid. Build. Technol. Des. 16 Perform. Anal. Build. Ind. Trends.
Stamnes, K., Thomas, G. E. & Stamnes, J. J. Radiative transfer in the atmosphere and ocean. (Cambridge University Press, 2017).
Sundarram, et al., "On Thermal Conductivity of Micro- and Nanocellular Polymer Foams," Polym. Eng. Sci., vol. 53, pp. 1901-1909, 2013.
Swimm, et al., "Impact of thermal coupling effects on the effective thermal conductivity of aerogels," J. Sol-Gel Sci. Technol., vol. 84, No. 3, pp. 466-474, 2017.
Swimm, et al., "Coupling of gaseous and solid thermal conduction in porous solids Solid phase Gas phase Solid phase," J. Non. Cryst. Solids, vol. 456, pp. 114-124, 2017.
The State of Food Security and Nutrition in the World 2020. FAO, IFAD, UNICEF, WFP and WHO, 2020.
Tong, et al., "Infrared-Transparent Visible-Opaque Fabrics for Wearable Personal Thermal Management," ACS Photonics, vol. 2, No. 6, pp. 769-778, 2015.
U.S. Energy Information Administration, "Monthly Energy Review—Apr. 2021," 2021.
Van Krevelen, et al. "Transport of Thermal Energy," Prop. Polym., 4th Rev Ed, Ch 17 pp. 645-653, 2009.
Verploegen, et al., "Evaluation of low-cost evaporative cooling technologies for improved vegetable storage in Mali." 2018 IEEE Global Humanitarian Technology Conference (GHTC). IEEE, 2018.
Verploegen, Eric, Peter Rinker, and Kukom Edoh Ognakossan. Evaporative cooling best practices: Producing and using evaporative cooling chambers and clay pot coolers. No. WorldVeg Staff Publication. MIT D-Lab, 2018.
Vicus Technologies LLC, "Development of Zinc Sulfide Seeker Window Material," Kennebunk, ME, 2005.
Wang, Chenxi, et al. "A thermal management strategy for electronic devices based on moisture sorption-desorption processes." Joule 4.2 (2020): 435-447.
Wei, et al., "Thermal conductivities study on silica aerogel and its composite insulation materials," Int. J. Heat Mass Transf., vol. 54, No. 11-12, pp. 2355-2366, May 2011.
Wilcox, et al. User Manual for TMY3 data sets, Citeseer, 2008.
Xie, et al., "Heat transfer characteristics of silica aerogel composite materials: Structure reconstruction and numerical modeling," Int. J. Heat Mass Transf., vol. 95, pp. 621-635, Apr. 2016.
Xie, et al., "Theoretical study on thermal conductivities of silica aerogel composite insulating material," Int. J. Heat Mass Transf., vol. 58, No. 1-2, pp. 540-552, 2013.
Yang, et al., "A dual-layer structure with record-high solar reflectance for daytime radiative cooling," Sol. Energy, vol. 169, No. April, pp. 316-324, Jul. 2018.
Yang, et al., "Bioinspired 'Skin' with Cooperative Thermo-Optical Effect for Daytime Radiative Cooling," ACS Appl. Mater. Interfaces, vol. 12, No. 22, pp. 25286-25293, Jun. 2020.
Yin, Xiaobo, et al. "Terrestrial radiative cooling: Using the cold universe as a renewable and sustainable energy source." Science 370.6518 (2020): 786-791.
Zamengo, et al., "Evaluation of cooling ability for a novel heat sink made of polyvinyl alcohol hydrogel," Int. J. Heat Mass Transf., vol. 143, p. 118523, Nov. 2019.
Zeng, et al., "Geometric Structure and Thermal Conductivity of Porous Medium Silica Aerogel," J. Heat Transfer, vol. 117, No. 4, pp. 1055-1058, Nov. 1995.
Zhai et al., "Scalable-manufactured randomized glass-polymer hybrid metamaterial for daytime radiative cooling," Science (80-. )., vol. 355, No. 6329, pp. 1062-1066, Mar. 2017.
Zhang et al., "Mechanically Robust and Spectrally Selective Convection Shield for Daytime Subambient Radiative Cooling," ACS Appl. Mater. Interfaces, vol. 13, No. 12, pp. 14132-14140, Mar. 2021.
Zhao, L., Yang, S., Bhatia, B., Strobach, E. & Wang, E. N. Modeling silica aerogel optical performance by determining its radiative properties. AIP Adv. 6, (2016).
Zhao, et al. "An experimental study of lithium ion battery thermal management using flexible hydrogel films." Journal of Power Sources 255 (2014): 29-36.
Zhao et al., "Subambient Cooling of Water: Toward Real-World Applications of Daytime Radiative Cooling Subambient Cooling of Water: Toward Real-World Applications of Daytime Radiative Cooling," Joule, pp. 1-13, 2019.
Zhu, et al., "Radiative cooling of solar absorbers using a visibly transparent photonic crystal thermal blackbody," Proc. Natl. Acad. Sci., vol. 112, No. 40, pp. 12282-12287, Oct. 2015.
Zhu, et al., "Color-preserving daytime radiative cooling," Appl. Phys. Lett., vol. 103, No. 22, p. 223902, Nov. 2013.
Pu, et al. "Promoting energy efficiency via a self-adaptive evaporative cooling hydrogel." Advanced Materials 32.17 (2020): 1907307.
PCT International Search Report and Written Opinion mailing date Feb. 8, 2023 and issued in connection with PCT/US2022/047947.
Harby, K., et al. "Performance improvement of vapor compression cooling systems using evaporative condenser: An overview." Renewable and sustainable energy reviews 58 (2016): 347-360.
Harrison, A. W. "Effect of atmospheric humidity on radiation cooling." Solar Energy 26.3 (1981): 243-247.
Harrison, et al., "Radiative cooling of TiO2 white paint," Sol. Energy, vol. 20, No. 2, pp. 185-188, 1978.
He, et al. "Advances of thermal conductivity models of nanoscale silica aerogel insulation material," Appl. Therm. Eng., vol. 81, pp. 28-50, 2015.

(56) References Cited

OTHER PUBLICATIONS

Heinemann, et al., "Radiation-conduction interaction: An investigation on silica aerogels," Int. J. Heat Mass Transf., vol. 39, No. 10, pp. 2115-2130, 1996.
Hjortsberg, et al., "Radiative cooling with selectively emitting ethylene gas," Appl. Phys. Lett., vol. 39, No. 6, pp. 507-509, Sep. 1981.
Hrubesh, et al., "Thermal properties of organic and inorganic aerogels," J. Mater. Res., vol. 9, No. 03, pp. 731-738, 1994.
Hsu, Po-Chun, et al. "Radiative human body cooling by nanoporous polyethylene textile."Science 353.6303 (2016): 1019-1023.
IEA, SDG7: Data and Projections, https://www.iea.org/reports/sdg7-data-and-projections.
International Energy Agency, "The Future of Cooling: Opportunities for energy-efficient air conditioning," 2018.I.
James, S. J., and C. J. F. R. I. James. "The food cold-chain and climate change." Food Research International 43.7 (2010): 1944-1956.
Jedermann, et al., "Reducing food losses by intelligent food logistics," Philos. Trans. R. Soc. A Math. Phys. Eng. Sci., vol. 372, No. 2017, 2014.
Keeley-LeClaire, Theo. "Evaporative-Radiant Cooling on Superhydrophilic Boehmitized Aluminum Surfaces." (2018).
Kim, et al., "Optical and thermal filtering nanoporous materials for sub-ambient radiative cooling," J. Opt., vol. 20, No. 8, p. 084002, Aug. 2018.
Kim, et al., "Wavelength Selective Cover for Sub-Ambient Passive Radiative Cooling," in International Heat Transfer Conference 16, 2018, pp. 8415-8422.
Kim et al., "Adsorption-based atmospheric water harvesting device for arid climates," Nat. Commun., vol. 9, No. 1, pp. 1-8, 2018.
Kou, et al., "Daytime Radiative Cooling Using Near-Black Infrared Emitters," ACS Photonics, vol. 4, No. 3, pp. 626-630, Mar. 2017.
Kumru, Ozan S., et al. "Vaccine instability in the cold chain: mechanisms, analysis and formulation strategies." Biologicals 42.5 (2014): 237-259.
Labuza, et al., "Applications of 'Active Packaging' for Improvement of Shelf-Life and Nutritional Quality of Fresh and Extended Shelf-Life Foods," J. Food Process. Preserv., vol. 13, No. 1, pp. 1-69, 1989.
Lee, et al., "Determination of mesopore size of aerogels from thermal conductivity measurements," J. Non. Cryst. Solids, vol. 298, No. 2-3, pp. 287-292, Mar. 2002.
Leroy, A. et al. High-performance subambient radiative cooling enabled by optically selective and thermally insulating polyethylene aerogel. Sci. Adv. 5, 1-9 (2019).
Li et al., "Scalable and hierarchically designed polymer film as a selective thermal emitter for high-performance all-day radiative cooling," Nat. Nanotechnol., vol. 16, No. 2, pp. 153-158, Feb. 2021.
Li, Tian, et al. "A radiative cooling structural material." Science 364.6442 (2019): 760-763.
Li, et al., "Photovoltaic panel cooling by atmospheric water sorption-evaporation cycle," Nat. Sustain., vol. 3, No. 8, pp. 636-643, Aug. 2020.
Li et al., "Integration of daytime radiative cooling and solar heating for year-round energy saving in buildings," Nat. Commun., vol. 11, No. 1, pp. 1-9, 2020.
Li, et al., "Ultrawhite BaSO 4 Paints and Films for Remarkable Daytime Subambient Radiative Cooling ," ACS Appl. Mater. Interfaces, 2021.
Li, et al, "Scalable Metal-Free Paint for Passive Radiative Cooling Under Direct Sunlight," in The Second Pacific Rim Thermal Engineering Conference, 2019, pp. 3-5.
Lu, et al.,Hybrid evaporative-radiative cooling architecture for large energy savings in building.
Lu, et al. "Passive sub-ambient cooling from a transparent evaporation-insulation bilayer." Joule 4.12 (2020): 2693-2701.
Lu, et al., "Correlation between structure and thermal conductivity of organic aerogels," J. Non. Cryst. Solids, vol. 188, No. 3, pp. 226-234, Aug. 1995.
Lushiku, et al., "Radiative cooling with selectively infrared emitting ammonia gas," J. Appl. Phys., vol. 53, No. 8, pp. 5526-5530, 1982.
Lv, et al., "Graphite-high density polyethylene laminated composites with high thermal conductivity made by filament winding," Express Polym. Lett., vol. 12, No. 3, pp. 215-226, 2018.
M. F. Modest, Radiative heat transfer, 3rd Ediiton. Academic press, 2013.
Mandal et al., "Hierarchically porous polymer coatings for highly efficient passive daytime radiative cooling," Science (80-. )., vol. 362, No. 6412, pp. 315-319, Oct. 2018.
Mandal et al., "Porous Polymers with Switchable Optical Transmittance for Optical and Thermal Regulation," Joule, vol. 3, No. 12, pp. 3088-3099, Dec. 2019.
Mastai, et al., "TiO2 nanocrystalline pigmented polyethylene foils for radiative cooling applications: Synthesis and characterization," Langmuir, vol. 17, No. 22, pp. 7118-7123, 2001.
Maxwell, A Treatise on Electricity and Magnetism, vol. I, 3rd ed. Oxford University Press, 1904.
Meggers, Forrest, et al. "The Thermoheliodome—"Air conditioning" without conditioning the air, using radiant cooling and indirect evaporation." Energy and Buildings 157 (2017): 11-19.
National Institute of Standards and Technology, "NIST Reference Fluid Thermodynamic and Transport Properties Database (REFPROP)."
Niklasson, et al., "Radiative Cooling With Pigmented Polyethylene Foils," Opt. Mater. Technol. Energy Effic. Sol. Energy Convers. VII, vol. 1016, No. May, p. 89, 1989.
Nilsson, et al., "Infrared-transparent convection shields for radiative cooling: Initial results on corrugated polyethylene foils," Sol. Energy Mater., vol. 12, No. 5, pp. 327-333, Nov. 1985.
Nilsson, et al., "A solar reflecting material for radiative cooling applications: ZnS pigmented polyethylene," Sol. Energy Mater. Sol. Cells, vol. 28, No. 2, pp. 175-193, 1992.
Nilsson, et al. "Radiative cooling during the day: simulations and experiments on pigmented polyethylene cover foils," Sol. Energy Mater. Sol. Cells, vol. 37, No. 1, pp. 93-118, 1995.
Notario, et al., "Experimental validation of the Knudsen effect in nanocellular polymeric foams," vol. 56, pp. 57-67, 2015.
P. L. Today, "Alternative refrigeration—Three methods of passive cooling," 2013. Archived online at: https://web.archive.org/web/20190901004846/www.provident-living-today.com/Alternative-Refrigeration.html.
Palik, et al., "Zinc Sulfide (ZnS)," in Handbook of Optical Constants of Solids, Washington, DC, 1998, pp. 597-619.
Peng, Yucan, et al. "Nanoporous polyethylene microfibres for large-scale radiative cooling fabric." Nature sustainability 1.2 (2018): 105-112.
Radi-Cool, "Radiative Cooling Environment-Friendly Cooling Technologies with Zero Energy Consumption," 2021. [Online]. Available: https://web.archive.org/web/20210126143151/https://radi-cool.com/.
Raman, Aaswath P., et al. "Passive radiative cooling below ambient air temperature under direct sunlight." Nature 515.7528 (2014): 540-544.
Rintoul, et al., "Precise determination of the critical threshold and exponents in a three-dimensional continuum percolation model," J. Phys. A. Math. Gen., vol. 30, No. 16, 1997.
Alvarez-Lainez, et al., "Thermal Conductivity of Open-Cell Polyolefin Foams," J. Polym. Sci. Part B Polym. Phys., vol. 46, No. 2, pp. 212-221, 2008.
ASHRAE Handbook—HVAC Systems and Equipment. (American Society of Heating, Refrigerating and Air-Conditioning Engineers, Inc. (ASHRAE).
ASHRAE, "Commodity storage requirements," ASHRAE Handb.—Refrig., pp. 21.1-21.11, 2014.
American Society of Heating, Refrigerating and Air-Conditioning Engineers, "39. Condensers," 2020 ASHRAE Handbook—HVAC Systems and Equipment (SI Edition), No. 1. American Society of Heating, Refrigerating and Air-Conditioning Engineers, Inc. (ASHRAE), 2020.
American Society of Heating, Refrigerating and Air-Conditioning Engineers, "2019 ASHRAE® Handbook Heating, Ventilating, and Air-Conditioning Applications (S-I Edition)—Chapter 50—Water treatment: deposition, corrosion, and biological control," American

(56) References Cited

OTHER PUBLICATIONS

Society of Heating, Refrigerating and Air-Conditioning Engineers, Inc. (ASHRAE). pp. 1- 24, 2019.
ASTM-E96/E96M, "Standard Test Methods for Water Vapor Transmission of materials, West Conshohocken," vol. i, p. 14p., 2016.
ASTM International, "ASTM C1044-16 Standard Practice for Using a Guarded-Hot-Plate Apparatus or Thin-Heater Apparatus in the Single-Sided Mode," West Conshohocken, PA, 2016.
Auer, et al., "White Pigments," in Industrial Inorganic Pigments, Weinheim, FRG: Wiley-VCH Verlag GmbH & Co. KGaA, 2005, pp. 51-97.
Aviv, Dorit, et al. "Hydrogel-based evaporative and radiative cooling prototype for hot-arid climates." Proceedings of the 11th Annual Symposium on Simulation for Architecture and Urban Design. 2020.
B. M. McGregor, "Tropical Products Transport Handbook," 1989.
Baechler, Michael C. High-performance home technologies: Guide to determining climate regions by county. US Department of Energy, Energy Efficiency & Renewable, Building Technologies Office, 2015.
Ball, et al., "The Thermal Conductivity on Rigid Urethane Foams," J. Cell. Plast., vol. 6, No. 2, pp. 66-75, Mar. 1970.
Baltimore Aircoil Company, "Evaporative Condenser Engineering Manual," 2021.
Bathgate, et al., "A robust convection cover material for selective radiative cooling applications," Sol. Energy Mater. Sol. Cells, vol. 95, No. 10, pp. 2778-2785, 2011.
Bell, I. H., Wronski, J., Quoilin, S. & Lemort, V. Pure and Pseudo-pure Fluid Thermophysical Property Evaluation and the Open-Source Thermophysical Property Library CoolProp. Ind. Eng. Chem. Res. 53, 2498-2508 (2014).
Benlattar, et al., "Radiative properties of cadmium telluride thin film as radiative cooling materials," Opt. Commun., vol. 256, No. 1-3, pp. 10-15, 2005.
Berk, A. et al. MODTRAN6: a major upgrade of the MODTRAN radiative transfer code. Algorithms Technol. Multispectral, Hyperspectral, Ultraspectral Imag. XX 9088, 90880H (2014).
Bhatia, Bikram, et al. "Passive directional sub-ambient daytime radiative cooling." Nature communications 9.1 (2018): 5001.
Bi, et al. "Effective thermal conductivity of the solid backbone of aerogel," Int. J. Heat Mass Transf., vol. 64, pp. 452-456, Sep. 2013.
Bohren, "Absorption and scattering of light by small particles," Absorpt. Scatt. Light by small Part., 1983.
Cai et al., "Spectrally Selective Nanocomposite Textile for Outdoor Personal Cooling," Adv. Mater., vol. 30, No. 35, pp. 1-7, 2018.
Cai et al., "Temperature Regulation in Colored Infrared-Transparent Polyethylene Textiles," Joule, vol. 3, No. 6, pp. 1478-1486, 2019.
Chasan, et al., "Infrared determination of inorganic sulfates and carbonates by the pellet technique," Philadelphia, 1969.
Chen, Zhen, et al. "Radiative cooling to deep sub-freezing temperatures through a 24-h day-night cycle." Nature communications 7.1 (2016): 13729.
Chen, et al., "Simultaneously and Synergistically Harvest Energy from the Sun and Outer Space," Joule, pp. 1-10, Nov. 2018.
Cuce, Pinar Mert, and Saffa Riffat. "A state of the art review of evaporative cooling systems for building applications." Renewable and Sustainable Energy Reviews 54 (2016): 1240-1249.
Cui, Shuang, et al. "Bio-inspired effective and regenerable building cooling using tough hydrogels." Applied Energy 168 (2016): 332-339.
Daniel, et a.l., "High porosity polyethylene aerogels," Polyolefins J., vol. 2, No. 1, pp. 49-55, 2015.
Deru, M. et al. US Department of Energy commercial reference building models of the national building stock. (National Renewable Energy Laboratory, 2011).
Dobos, A. P. PVWatts version 5 manual. (2014).
Dong, Minghao, et al. "Nighttime radiative cooling in hot and humid climates." Optics express 27.22 (2019): 31587-31598.
Ekmekçi, I. & Ermics, K. Air cooled condensers and their effect on energy efficiency. In (2015).
Ezekwe, C. I. Performance of a heat pipe assisted night sky radiative cooler. Energy Convers. Manag. 30, 403-408 (1990).
Feng, Chunzao, et al. "Bilayer porous polymer for efficient passive building cooling." Nano Energy 85 (2021): 105971.
Fernandez, Nicholas, et al. Energy savings potential of radiative cooling technologies. No. PNNL-24904. Pacific Northwest National Lab.(PNNL), Richland, WA (United States), 2015.
Ferber et al., "Evaporative Cooling Hydrogel Packaging for Storing Biologics Outside of the Cold Chain," Adv. Healthc. Mater., vol. 7, No. 14, p. 1800220, 2018.
Foley et al., "Solutions for a cultivated planet," Nature, vol. 478, No. 7369, pp. 337-342, Oct. 2011.
Fu, et al., "U.S. Solar Photovoltaic System Cost Benchmark: Q1 2018," NREL Golden, CO:, 2018.
Gao et al., "Three-Dimensional Printed Thermal Regulation Textiles," ACS Nano, vol. 11, No. 11, pp. 11513-11520, Nov. 2017.
Gentle, Angus R., and Geoff B. Smith. "A subambient open roof surface under the Mid-Summer sun." Advanced Science 2.9 (2015).
Gentle, et al., "Radiative Heat Pumping from the Earth Using surface phonon resonant nanoparticles," Nano Lett. 10 pp. 373-379, 2010.
Gentle, et al., "Polymeric mesh for durable infra-red transparent convection shields: Applications in cool roofs and sky cooling," Sol. Energy Mater. Sol. Cells, vol. 115, pp. 79-85, Aug. 2013.
Glicksman, "Heat Transfer in fFoams," Ch. 5 in Low density cellular plastics: Physical basis of behavior, First., N. C. Hilyard and A. Cunningham, Eds. Springer Science + Business Media, 1994, pp. 104-152.
Goldstein, Eli A., Aaswath P. Raman, and Shanhui Fan. "Sub-ambient non-evaporative fluid cooling with the sky." Nature Energy 2.9 (2017): 1-7.
Gong, et al., "Heat transfer in microcellular polystyrene / multi-walled carbon nanotube nanocomposite foams,"Carbon vol. 93, Nov. 2015. 819-829.
González, Eduardo, and Baruch Givoni. "Radiative and radiative/evaporative passive cooling systems for a hot humid climate—Maracaibo." PLEA 2004 (2004).
Granqvist, C. G., A. Hjortsberg, and T. S. Eriksson. "Radiative cooling to low temperatures with selectivity IR-emitting surfaces." Thin Solid Films 90.2 (1982): 187-190.
Gulmine, et al., "Polyethylene characterization by FTIR," Polym. Test., vol. 21, No. 5, pp. 557-563, Jan. 2002.
Gustavsson, et al., The methodology of the FAO study: "Global Food Losses and Food Waste—extent, causes and prevention," No. 857. The Swedish Institute for Food and Biotechnology, 2013.
Han, et al., "Thermal conductivity of carbon nanotubes and their polymer nanocomposites: A review," Prog. Polym. Sci., vol. 36, No. 7, pp. 914-944, 2011.
Li, Xiangyu, et al. "Full daytime sub-ambient radiative cooling with high figure of merit in commercial-like paints." Cell Reports Physical Science Journal, vol. 1, Issue 10, Oct. 21, 2020 ((https://www.sciencedirect.com/science/article/pii/S2666386420302368?ssrnid=3652325&dgcid=SSRN_redirect_SD).

* cited by examiner

Temperature and humidity controlled chamber

HYBRID EVAPORATIVE-RADIATIVE COOLING PANELS

CROSS-REFERENCE TO RELATED APPLICATIONS

This application is a U.S. national counterpart application of International Application Serial No. PCT/US2022/047947, entitled "Hybrid Evaporative-Radiative Cooling Panels," filed Oct. 26, 2022, which claims priority to and the benefit of U.S. Provisional Application No. 63/272,035, entitled "Hybrid Evaporative-Radiative Cooling Panels" and filed on Oct. 26, 2021, the contents of which is incorporated herein by reference in its entirety their entireties.

FIELD

The present disclosure relates to cooling panels designed to use a heat transfer fluid in conjunction with condensers, such as condensers associated with air conditioners or refrigerators, and more particularly relates to panels that use a hybrid evaporative and radiative cooling approach to cool the heat transfer fluid.

BACKGROUND

The general purpose of the disclosed technology is to address the ever-increasing global cooling needs. Rising demand for cooling is driving up carbon emissions while putting enormous strain on electricity systems around the world. At the current pace, by 2050, the global cooling energy demand is projected to triple and account for about 37% of the end use of electricity demand growth in buildings. This is largely driven by economic and population growth in the hottest part of the world as global development is shifting south. To accommodate this trend and manage the associated carbon footprint presents a grand challenge that is exacerbated by the large share of cooling in peak electricity load. The peak demand requires additional capacity of electricity, which is costly to build and maintain. Further, in many places, the high cooling needs can last well beyond the hours when solar energy is available.

Space cooling, which was responsible for over 1 gigatonnes $CO_2$ emissions and 8.5% of the electricity consumption in the world in 2019, is the fastest-growing end-use of energy in the building sector. Cooling efficiency improvement would be desirable to reduce the demand for installing new electricity generation and storage capacity, and lessen the peak load on power supply systems. With greater than 10% of the world's population still lacking regular access to electricity, passive cooling provides a particularly attractive pathway to addressing the global cooling needs with little electric power and carbon footprint, not only for human thermal comfort, but also to store and distribute food and pharmaceuticals.

Previous passive cooling solutions based on evaporation and radiation, while showing promise, face challenges associated with solar and environmental heating, large water expenditure, low cooling powers, and climate condition constraints. Evaporative cooling relies on the large enthalpy of vaporization to generate high cooling power, which has been used for condenser heat rejection, direct air cooling, and storage of perishable goods. Nevertheless, evaporative coolers consume a significant amount of water and can be severely heated due to solar absorption, reaching between 10° C. to 20° C. above the ambient instead of subambient temperatures at stagnation. Although shading can reduce solar heating, it is challenging for large cooling areas and potentially restricts external air flow. Additionally, shading inevitably blocks radiative cooling, which leverages thermal radiation to transfer energy toward the cold outer space through the mid-infrared (mid-IR) transparent window of the atmosphere. Radiative cooling offers a net cooling power typically <120 W/m$^2$ at the ambient temperature. In practice, high performance radiative cooling (~100 W/m$^2$ cooling power or ~10° C. stagnation temperature drop) has only been demonstrated in high altitude areas with low atmospheric density and low relative humidity (RH) or under indirect sunlight.

Further, the applicability of passive cooling to buildings depends on not only the cooling performance but also the integration strategy. Previously, direct cooling of air or building roofs was proposed, but could only provide minimal energy benefits due, at least in part, to the low subambient cooling performance and large thermal resistance of the building envelope. For pure radiative cooling, rooftop fluid panels have been designed to allow for integration at the condenser side of air-conditioning and refrigeration (ACR) systems, but the total energy savings are still limited by the low net cooling power. Because rooftop space is often desirable for passive cooling technologies, wide adoption would prefer the resulting electricity savings to be competitive with rooftop PV panels of the same area, which has not yet been shown. It would also be advantageous that such passive cooling provides improved cooling efficiency to the building as compared to pure radiative cooling panels.

Accordingly, there is a need for improved methods of passive cooling that are more efficient than existing ACR technology and the like.

SUMMARY

This Summary introduces a selection of concepts in simplified form that are described further below in the Detailed Description. This Summary neither identifies key or essential features, nor limits the scope, of the claimed subject matter.

The present disclosure relates to potential solutions to the above-described shortcomings of passive cooling technology. In particular, such solutions include a hybrid evaporative-radiative cooling system that significantly outperforms previous passive cooling technologies and can enable energy savings higher than state-of-the-art photovoltaic (PV) panels occupying the same rooftop area. In at least one illustrative embodiment, the hybrid cooling structure comprises a solar reflector, a water-rich and IR-emitting evaporative layer, and a vapor-permeable, IR-transparent, and solar-reflecting insulation layer, with a cooling panel having a heat transfer fluid that passes through and/or across the cooling panel.

One embodiment of a cooling panel includes a reflector layer and an evaporative and infrared-emitting layer. The cooling panel is configured to be in fluid communication with a heat exchanger. Further, the cooling panel is configured to cool a heat transfer fluid by way of both evaporative cooling and radiative cooling. Still further, the cooling panel is also configured such that the heat transfer fluid passes at least one of through or across the cooling panel and flows to the heat exchanger.

The reflector layer can include a solar-reflecting material. The solar-reflecting material can include, by way of non-limiting examples: white paint, metallic film, a porous-polymeric layer, a metamaterial layer, and/or a multiplayer polymeric film. In some embodiments, the solar-reflecting material can be a 3M Enhanced Specular Reflector (ESR) film.

The evaporative and infrared-emitting layer can include a solar-transparent material. The solar-transparent material can include, by way of non-limiting examples, hydrogel and/or water. In some embodiments in which the solar-transparent material includes a hydrogel, the hydrogel can include a polyacrylamide hydrogel. The hydrogel can include, for example, free radical copolymerization of acrylamide and 2 acrylamido 2 methylpropan sulfonic acid. In at least some embodiments, the reflector layer and the evaporative and infrared-emitting layer can be formed as an integrated, single layer.

The heat transfer fluid that passes at least one of through or across the cooling panel can flow at least one of through or across the evaporative and infrared-emitting layer. The evaporative and infrared-emitting layer can include the heat transfer fluid. In at least some instances, the evaporative and infrared-emitting layer can be configured to receive the heat transfer fluid such that at least a portion of the heat transfer fluid is supplied from outside of the evaporative and infrared-mitting layer. In at least some embodiments, an entirety of the heat transfer fluid flowing through the cooling panel can flow through and/or across the evaporative and infrared-emitting layer. The evaporative and infrared-emitting layer can include at least one of water, a water film, and/or an infrared-emitting material flowing through it.

The cooling panel can also include a heat transfer fluid layer. In some such embodiments, the reflector layer can be disposed above the heat transfer fluid layer and the evaporative and infrared-emitting layer can be disposed above the reflector layer. The heat transfer fluid layer can be configured to be in fluid communication with the heat exchanger, and the cooling panel can be further configured to cool the heat transfer fluid that passes through and/or across the heat transfer fluid layer and flows to the heat exchanger.

In at least some embodiments that include a heat transfer fluid layer, the heat transfer fluid layer, the reflector layer, and the evaporative and infrared-emitting layer can be formed as an integrated, single layer. An integrated single layer can include any combination of a heat transfer fluid layer, a reflector layer, and/or an evaporative and infrared-emitting layer. Additionally, or alternatively, an entirety of the heat transfer fluid flowing through the cooling panel can flow at least through and/or across the heat transfer fluid. Alternatively, a first portion of the heat transfer fluid flowing through the cooling panel can flow through and/or across the evaporative and infrared-emitting layer and a second portion of the heat transfer fluid flowing through the cooling panel can flow through and/or across the heat transfer fluid layer.

The cooling panel can also include an insulation layer. The insulation layer can be disposed above the evaporative layer. In at least some embodiments, the insulation layer can include a vapor-permeable, infrared-transparent, and solar-reflecting material. By way of non-limiting example, the insulation layer can have total solar reflectance and total IR transmittance. In at least some embodiments in which the insulation layer includes a vapor-permeable, infrared-transparent, and solar-reflecting material, the material can include polyethylene aerogel, porous polyethylene, and/or polyethylene fabric. By way of non-limiting example, the insulation layer can include 08-052 gel, HiwowSport.

In at least some embodiments that include an insulation layer, the insulation layer and the evaporative and infrared-emitting layer can be formed as an integrated, single layer. In at least some embodiments that include an insulation layer, the insulation layer can have a thickness as measured from a top surface to a bottom surface of the insulation layer that is greater than a thickness of the evaporative and infrared-emitting layer as measured from a top surface to a bottom surface of the evaporative and infrared-emitting layer.

One embodiment of a method of cooling includes causing a heat transfer fluid to pass across and/or through a cooling panel and cooling the heat transfer fluid both by evaporative cooling and radiative cooling while the heat transfer fluid passes across and/or through the cooling panel. The method further includes directing the cooled heat transfer fluid to a condenser to at least one of: (a) desuperheat a material disposed in the condenser (e.g., refrigerant); (b) sub-cool the condenser; and/or (c) lower the temperature of the condenser.

The aforementioned method can include the cooling panel as described in any combination of the preceding paragraphs, or as otherwise provided for in the present disclosure. The action of causing a heat transfer fluid to pass across and/or through a cooling panel can further include operating a pump to circulate the heat transfer fluid between the cooling panel and the condenser.

The action of cooling the heat transfer fluid by evaporative cooling and radiative cooling can further include dissipating heat from the heat transfer fluid by thermal radiation, and dissipating heat from the heat transfer fluid by water evaporation.

The method can further include carrying out the cooling the heat transfer fluid both by evaporative cooling and radiative cooling while the heat transfer fluid passes across and/or through the cooling panel via the evaporative and infrared-emitting layer and the reflector layer of the cooling panel. In at least some such embodiments, the cooling of the heat transfer fluid both by evaporative cooling and radiative cooling can include emitting thermal radiation from the evaporative and infrared-emitting layer. Additionally, or alternatively, the method can further include carrying out the cooling the heat transfer fluid both by evaporative cooling and radiative cooling while the heat transfer fluid passes across and/or through the cooling panel via the insulation layer. In at least some such embodiments, the cooling of the heat transfer fluid both by evaporative cooling and radiative cooling can further include reflecting solar energy off of the insulation layer. The cooling of the heat transfer fluid both by evaporative cooling and radiative cooling can also include allowing at least some of the emitted thermal radiation from the evaporative and infrared-emitting layer and the evaporated fluid from the evaporative and infrared-emitting layer to pass through the insulation layer.

The condenser can be at least one of part of an air conditioner, part of a refrigerator, disposed on a building, and/or disposed in a field. In at least some embodiments, an entirety of the heat transfer fluid to be cooled can be provided to the cooling panel by the condenser. A first portion of the heat transfer fluid to be cooled can be provided to the cooling panel by the condenser and at second portion of the heat transfer fluid to be cooled can be provided to the cooling panel by a second fluid source that is different than the condenser.

A heat exchanger of the condenser can be part of a free cooling cycle in which the heat exchanger is in fluid communication with hot air from a building. The hot air from the building can be directed on top of a conduit and/or a coil through which the cooled heat transfer fluid flows, for example a heat exchanger disposed between the heat transfer fluid and the air. Alternatively, or additionally, the hot air from the building can be directed to a secondary heat transfer fluid that is in fluid communication with the cooled heat transfer fluid.

The action of directing the cooled heat transfer fluid to a condenser can be done by a heat exchanger. In at least some embodiments, the method can include recirculating the heat transfer fluid into the cooling panel after having passed through the condenser. The method can also include outputting a first portion of the heat transfer fluid to the condenser from the heat exchanger and outputting a second portion of the heat transfer fluid to the cooling panel from the heat exchanger. In at least some embodiments, the method can also include directing the heat transfer fluid to the condenser after the heat transfer fluid has been directed to a heat exchanger after having passed at least across and/or through the cooling panel. Directing can occur, for example, by way of one or more pumps.

BRIEF DESCRIPTION OF THE DRAWINGS

The following Detailed Description references the accompanying drawings which form a part this application, and which show, by way of illustration, specific example implementations, in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure. Further, the present disclosure provides some illustrations and descriptions that include prototypes, bench models, experimental setups, and/or schematic illustrations of setups. A person skilled in the art will recognize how to rely upon the present disclosure to integrate the techniques, systems, devices, and methods provided for herein into a product and/or a system provided to customers, such customers including but not limited to individuals in the public or a company that will utilize the same within manufacturing facilities or the like. To the extent features are described as being disposed on top of, below, next to, etc. such descriptions are typically provided for convenience of description, and a person skilled in the art will recognize that, unless stated or understood otherwise, other locations and positions are possible without departing from the spirit of the present disclosure.

Approximating language, as used herein throughout the specification and claims, may be applied to modify any quantitative representation that could permissibly vary without resulting in a change in the basic function to which it is related. Accordingly, a value modified by a term or terms, such as "about", and "substantially" is not to be limited to the precise value specified. In some instances, the approximating language may correspond to the precision of an instrument for measuring the value. In some instances, "approximately" may be equal to +/−2% of the indicated value.

Unless otherwise defined, all technical terms used herein have the same meaning as commonly understood by one of ordinary skill in the art to which this disclosure belongs. Additionally, like-numbered components across embodiments generally have similar features unless otherwise stated or a person skilled in the art would appreciate differences based on the present disclosure and his/her knowledge. Accordingly, aspects and features of every embodiment may not be described with respect to each embodiment, but those aspects and features are applicable to the various embodiments unless statements or understandings are to the contrary.

ERCP System

Figure 1:
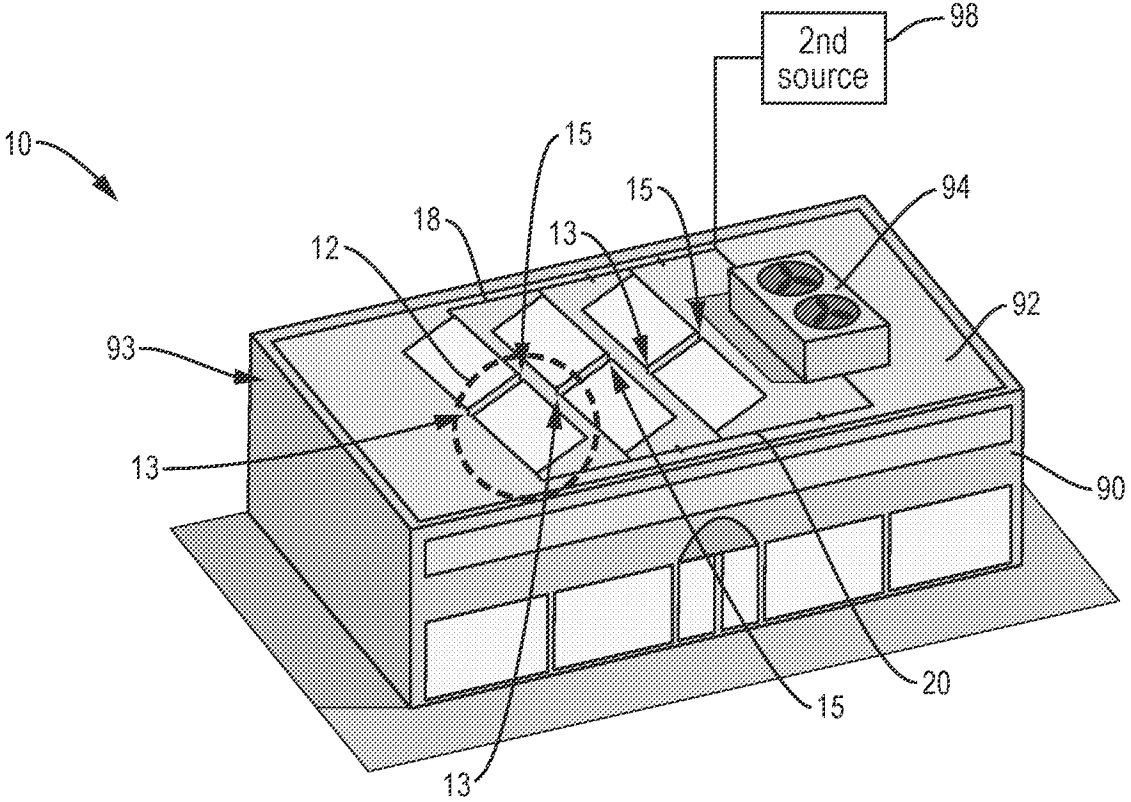
FIG. 1 is a perspective view of a hybrid evaporative and radiative cooling panel system according to the present disclosure utilized in a rooftop air-conditioning application.
Figure 2A:
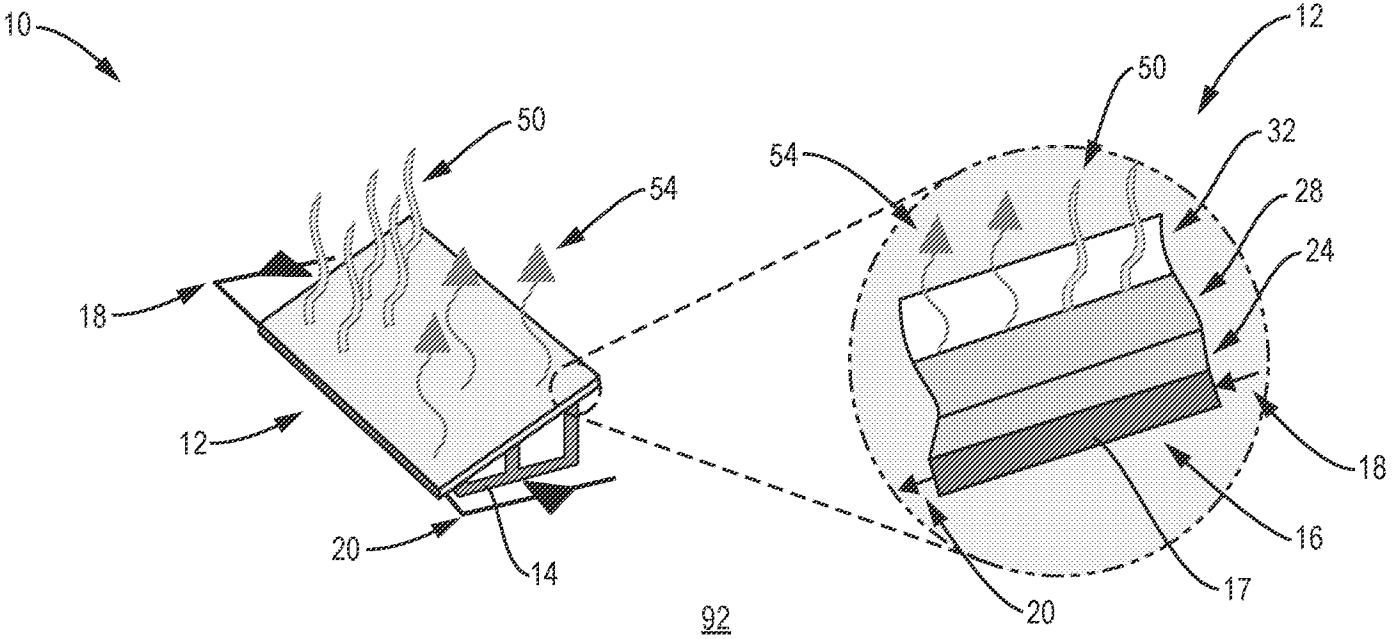
FIG. 2A is a perspective and magnified view of the hybrid evaporative and radiative cooling panel system of FIG. 1, showing that the system includes a stack of panels including a fluid-cooling panel having heat transfer fluid flowing at least partially therein, a solar reflecting layer, a solar-transparent infrared-emitting and water-rich layer, and a vapor-permeable, IR-transparent, and solar-reflecting insulation layer.

The present disclosure provides for a hybrid evaporative and radiative cooling panel ("ERCP") system 10, illustrated in FIGS. 1 and 2A, the produces passive cooling to building components or units such as condensers of air conditioners and refrigerators. As provided for herein, the ERCP system 10, as well as other systems disclosed herein or otherwise derivable from the present disclosures (e.g., ERCP systems 10', 10" of FIGS. 2B and 2C, respectively), can achieve temperatures that are significantly colder (e.g., at least 5° C. cooler, at least 10° C. cooler) than what is currently achievable for such building components or units. This includes achieving temperatures that can be up to about 30° C. cooler in comparison to technology used currently with units such as condensers of air conditioners and refrigerators.

As shown in FIG. 1, the ERCP system 10 may be arranged on a roof 92 of a building 90 for use with one or more building systems, as shown an air conditioning unit 94. Other non-limiting examples of building systems with which the ERCP 10, and other ERCPs disclosed herein or otherwise derivable from the present disclosure, can be used include a refrigeration system. In the illustrated embodiment, the ERCP system 10 includes multiple panel stacks 12 disposed on the roof 92, the stacks 12 being in fluidic communication with each other by way of conduits 13, 15, and with the air conditioning unit 94 by way of conduits 18, 20.

One exemplary embodiment of the ERCP system 10 according to the present disclosure is illustrated in greater detail in FIG. 2A. As shown, the system 10 can include a stack of panels, or cooling panel stack, 12 comprising a fluid heat exchange panel 16, which can also be referred to at a fluid cooling panel or, in at least some configurations, a heat transfer fluid layer, a solar reflecting layer 24, a solar-transparent infrared-emitting and water-rich layer 28, also referred to as an evaporative layer, and a vapor-permeable, IR-transparent, and solar-reflecting insulation layer 32, also referred to as an insulation layer. Alternative configurations of ERCP systems 10', 10" are illustrated and described with respect to FIGS. 2B and 2C. A person skilled in the art, in view of the present disclosures, will understand how systems 10', 10", as well as other systems disclosed herein or otherwise derivable from the present disclosures, can be used in conjunction with components of buildings, such as the air conditioning unit 94 on the building 90 and/or refrigeration systems.

In at least one non-limiting example, the layers of the cooling panel stack 12 may be arranged, from bottommost to topmost layer, the fluid heat exchange panel 16 on the bottom, a solar reflecting layer 24 above the fluid heat exchange panel 16, the evaporative layer 28 above the solar reflecting layer 24, and the insulation layer 32 above the evaporative layer 28 and covering, or at least substantially covering (e.g., at least about 80%, although other coverage below and above 80% are possible) the evaporative layer 28. The insulation layer 32 can reduce the environmental heating when the ERCP system 10 is below the ambient temperature and water consumption while increasing the solar reflectance of the entire ERCP system 10. In some embodiments, the solar reflecting layer 24 can also include evaporative and infrared-emitting properties and serve as an additional evaporative layer and/or an evaporative, infrared-emitting layer.

Figure 2B:
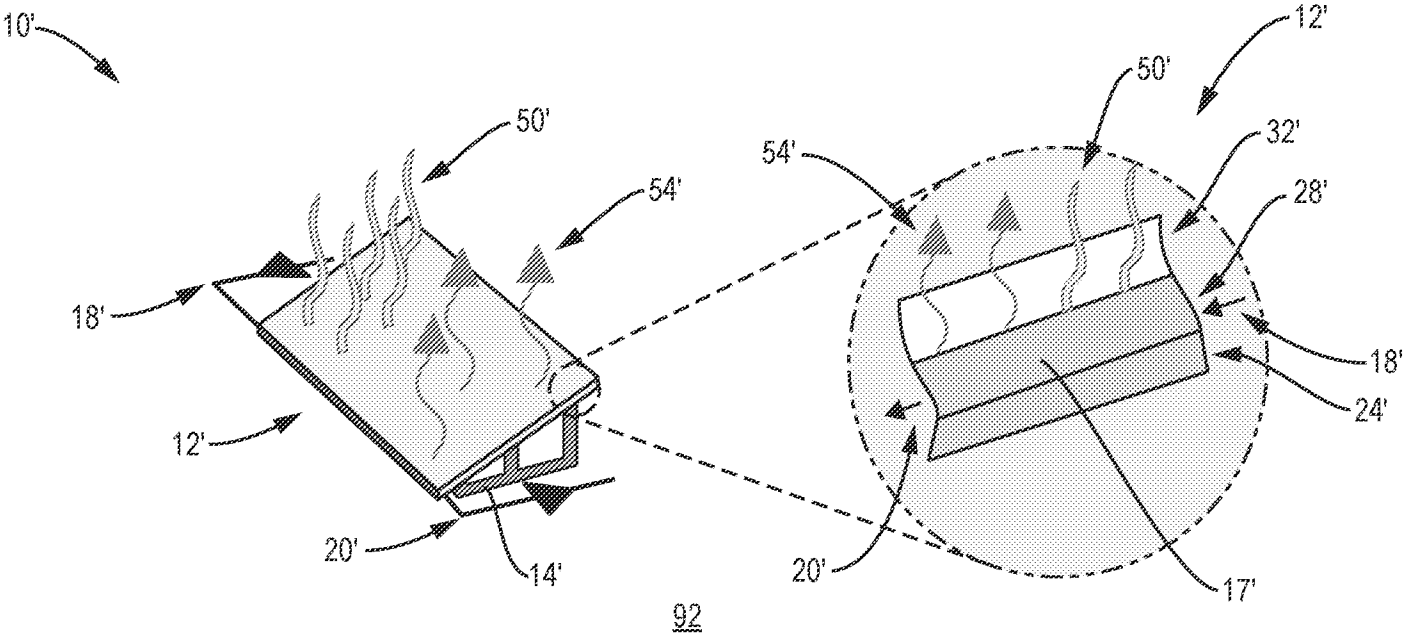
FIG. 2B is a perspective and magnified view of an alternative hybrid evaporative and radiative cooling panel system that is an alternative to the system of FIG. 2A, showing that the system can be configured such that the heat transfer fluid only flows through the evaporative layer.
Figure 2C:
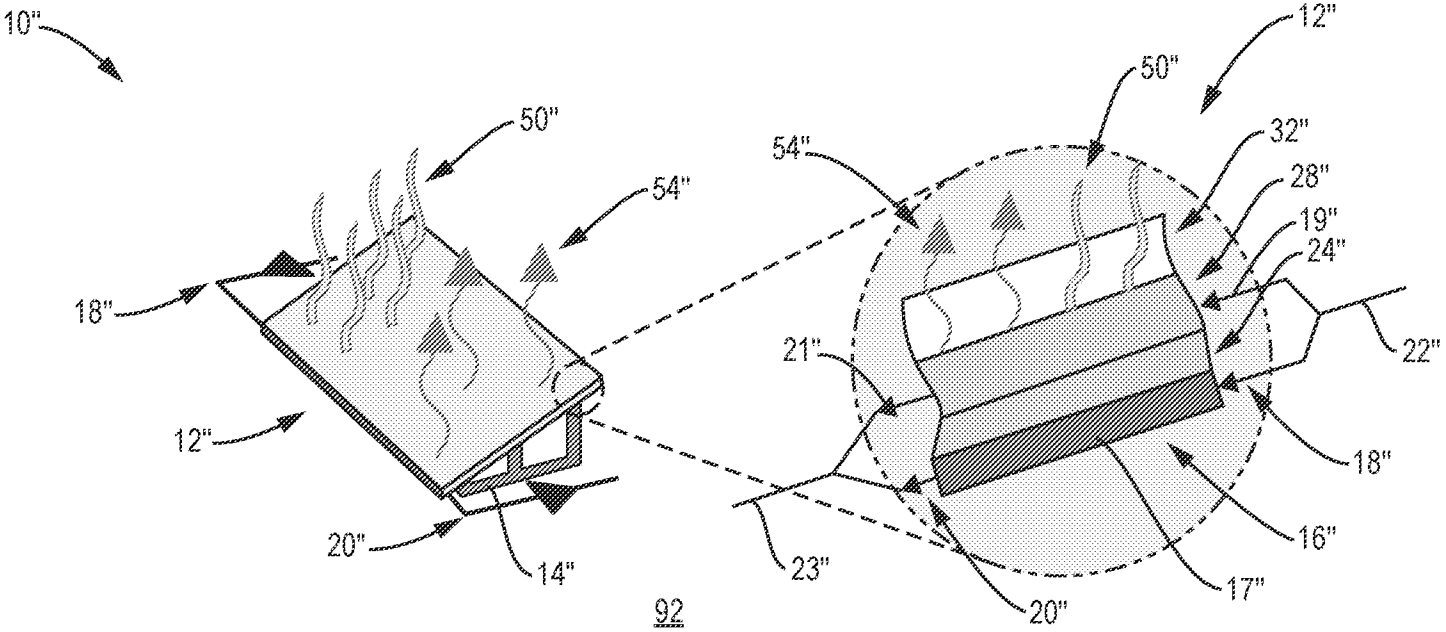
FIG. 2C is a perspective and magnified view of a further alternative hybrid evaporative and radiative cooling panel system that is an alternative to the systems of FIGS. 2A and 2B, showing that the system can be configured such that the heat transfer fluid flows through the evaporative layer and the fluid-cooling panel.

In some embodiments, the panel stack 12 may be arranged on a support frame 14, as shown in FIG. 2A. The same support frame 14 is also illustrated for use in conjunction with other non-limiting configurations of the ERCP systems 10', 10", shown in FIGS. 2B and 2C. The support frame 14 may be comprised of a plurality of support beams configured to hold the panel stack 12 in position, such as a position facing the sky in at least some exemplary embodiments. By way of a non-limiting example, the support frame 14 may be configured to hold the panel stack 12 at an angle relative to the sky. For example, the support frame 14 can be designed in a manner that helps prevent the stack 12 from facing the sun to, at least in some instances, help minimize undesired solar heating of the stack 12. For example, the support frame 14 can be configured to hold the panel stack 12 at an angle between 0° and 90° relative to a surface on which the frame 14 is supported on, such as a roof 92 of a building 90, as shown in FIG. 1, and/or a wall 93 of the building 90. By way of a further non-limiting example, the support frame 14 can be configured to hold the panel stack 12 at an angle approximately in the range of about 15° to about 75°. By way of a further non-limiting example, the support frame 14 can be configured to hold the panel stack 12 at an angle approximately in the range of about 30° to about 60°. By way of a further non-limiting example, the support frame 14 can be configured to hold the panel stack 12 at an angle of about 30°, as shown in FIGS. 2A-2C. In some instances, it can be desirable for the stack 12 to be at 0 degrees (i.e., be horizontal) or tilted away from the sun. In some embodiments, the support frame 14 can be adjustable, thus allowing the panel stack 12 to be moved between angles in the provided ranges.

The fluid heat exchange panel 16 is configured to facilitate the flow of a heat transfer fluid 17 through the ERCP system 10, as shown in FIG. 2A. The fluid 17 can be configured to pass through and/or across the fluid heat exchange panel 16, and can be configured to flow from an outside source, for example from the air conditioning unit 94. Illustratively, an entirety of the heat transfer fluid 17 can flow through the fluid heat exchange panel 16, which in at least some instances can be referred to as a layer, to directly interact with the reflecting layer 24. In some embodiments, the fluid 17 can be water, alcohols, mixtures of water and additives (e.g., ethylene glycol/water mixture, propylene glycol/water mixture, alcohol/water mixture, etc.), silicone fluids, gases, and other types of heat transfer fluids found in commercial heating and cooling systems. In some embodiments, a first portion of the heat transfer fluid 17 to be cooled can be provided to the cooling panel 12 by the condenser 94 and at second portion of the heat transfer fluid 17 to be cooled can be provided to the cooling panel 12 by a second fluid source 98 different than the condenser 94 (see FIG. 1). By way of non-limiting examples, the second fluid source 98 can be a heat transfer fluid storage tank, a source of new heat transfer fluid, or a combination of both. A storage tank has potential to store the colder heat transfer fluid 17 that can be created at night when the temperature is cooler and then used the next day when it is warmer outside.

Figure 4:
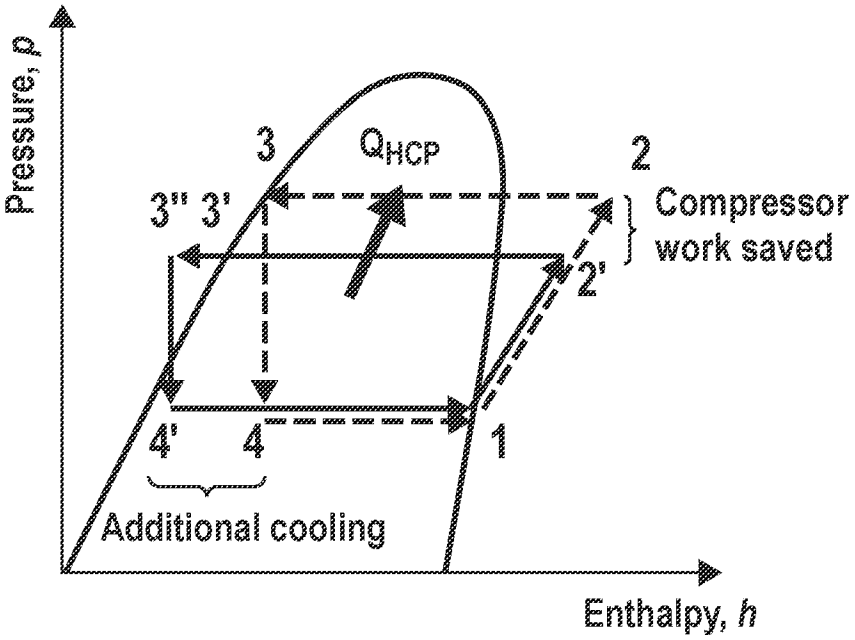
FIG. 4 is a pressure-enthalpy graphical diagram of a refrigeration cycle of the hybrid evaporative and radiative cooling panel system of FIG. 3, characterized by the compression (1-2 of FIG. 3), the heat rejection to the ambient or condensation (2-3 of FIG. 3), the expansion (3-4 of FIG. 3), and the cooling or evaporation (4-1 of FIG. 3) of a refrigerant.

In some embodiments, the heat transfer fluid 17 is not entirely provided by the condenser 94. For example, the condenser 94 can function as a heat exchanger for refrigerant with the ambient environment. The heat transfer fluid 17 can interact with the refrigerant, for example within the heat exchanger 40, and can decrease the refrigerant temperature inside a refrigerant loop, as described in greater detail below. In some embodiments, the heat exchanger 40 can act as a condenser, that is, by providing the necessary heat sink for the refrigerant to condense). Condensation can release heat and the release heat can be taken away by the heat transfer fluid 17. This can be the case, for instance, where the condensation temperature of the refrigerant is lowered (see 2-3 to 2'-3' as shown in FIG. 4), as explained in greater detail below. In some embodiments, the heat exchanger 40 can be considered a condenser, in particular the condenser 94. In some embodiments, the heat exchanger 40 can provide refrigerant sub-cooling (see 3' to 3" as shown in FIG. 4 and explained in greater detail below) or desuperheating. This can be carried out after or before, respectively, the condenser 94.

In some embodiments, a similar ERCP system 10' may be arranged as shown in FIG. 2B, which includes prime reference numbers indicating features that are common between the ERCP system 10 and the ERCP system 10', unless otherwise indicated or understood by a person skilled in the art. Illustratively, the fluid 17' can be configured to flow through and/or across the evaporative layer 28', as shown in FIG. 2B. For example, if the evaporative layer 28' includes water, a water film, and/or other infrared-emitting materials/films, in some instances the water or the like can serve as the heat transfer fluid 17', or at least a portion of the heat transfer fluid 17'. The evaporation of the water can also cause evaporative cooling. In some embodiments, the heat transfer fluid 17' itself can form an entirety of the evaporative layer 28', while in some other embodiments, the heat transfer fluid 17' itself can form only a part of the evaporative layer 28'. For example, the heat transfer fluid 17', which may be water, can flow directly over the top surface of the reflecting layer 24 and beneath the insulation layer 32. As a portion of the heat transfer fluid 17' evaporates, it can cool down. A person skilled in the art will understand that, in instances in which an entirety of the fluid 17' is directed through the evaporative layer 28', a fluid heat exchange panel 16' may be removed from the panel stack 12', as fluid is no longer flowing through the fluid heat exchange panel 16'.

A person skilled in the art will understand that the various layers of the cooling panel stacks 12 described herein (e.g., stacks 12, 12', 12", 212, 312) can each be configured to perform multiple functions and need not be physically separate from each other. This allows for the elimination of unused layers, such as the removal of the fluid heat exchange panel 16' in the embodiment described above. For example, as also described with reference to FIG. 2B, the fluid heat exchange panel 16' and the evaporative layer 28' can be combined to provide both the evaporative and infrared-emitting functions of the evaporative layer 28' while also providing the fluid 17' transport and interaction with the reflecting layer 24'. By way of another non-limiting example, the evaporative layer 28 can provide solar reflection functionality while also providing evaporation of water. Moreover, any of the layers may be combined into integrated, single layers, in any combination, such as combining the evaporative layer 28 and the reflecting layer 24 into a single layer.

In some embodiments, a similar ERCP system 10" may be arranged as shown in FIG. 2C, which includes double prime reference numbers indicating features that are common between the ERCP system 10, the ERCP system 10', and the ERCP system 10", unless otherwise indicated or understood by a person skilled in the art. Illustratively, a portion of the fluid 17" may flow through and/or across a fluid heat exchange panel 16" and a second portion of the fluid 17", which may be the entire remainder of the fluid 17", may flow through and/or across the evaporative layer 28". For example, conduits 18". 20" may be connected to the fluid heat exchange panel 16", while additional conduits 19", 21" can be connected to the evaporative layer 28" such that the fluid 17" may flow to both layers 16", 28". In some embodiments, the conduits 18", 19" may split off of a main line 22" before entering the layers 16", 28", and the conduits 20", 21" may converge to a main line 23" after exiting the layers 16", 28", as shown in FIG. 2C.

Figure 3:
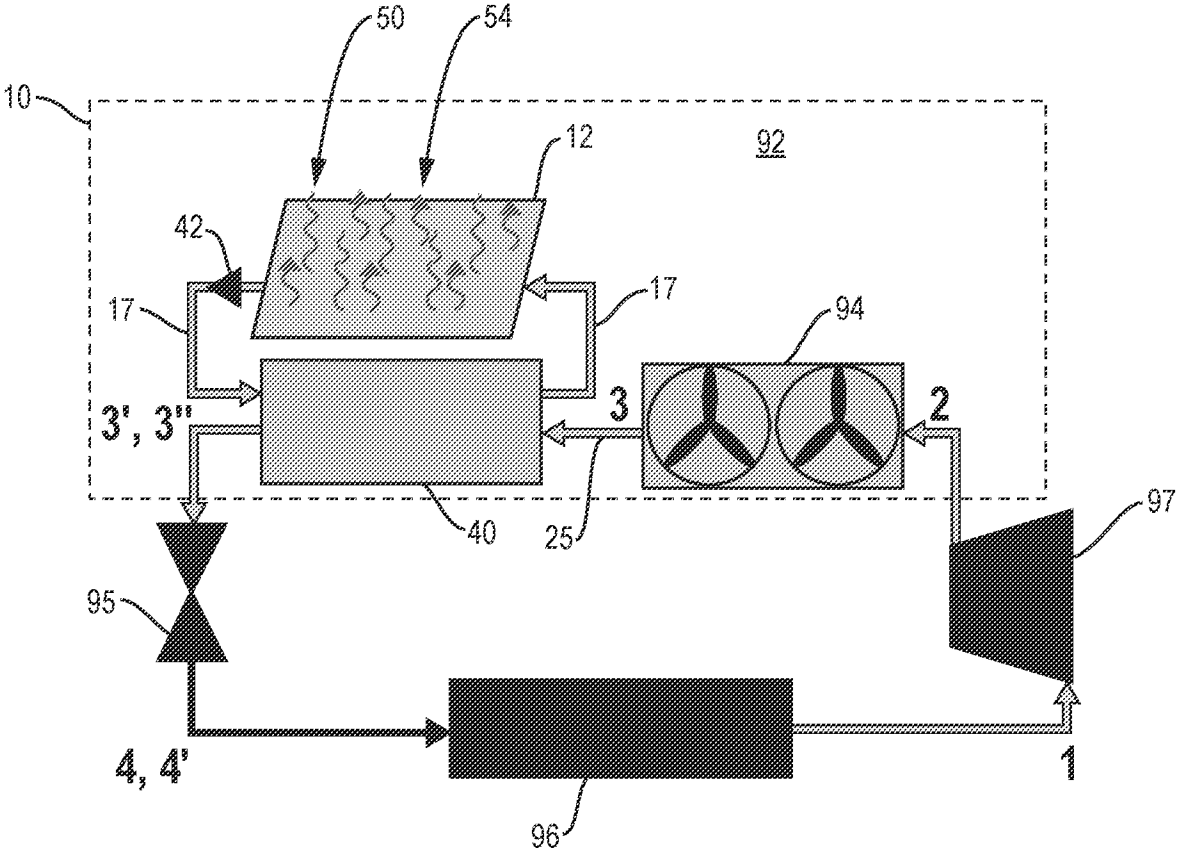
FIG. 3 is a schematic view of the hybrid evaporative and radiative cooling panel system of FIG. 2A, showing that the system can further include a heat exchanger, an evaporator, and a compressor for recirculating heat transfer fluid.

As shown in FIG. 3, as the heat transfer fluid 17 (which, in some examples, can be water flowing through the evaporative layer 28) cools down by radiative and evaporative cooling by flowing, for example, on top of the solar reflecting layer 24, the heat transfer fluid 17 can then be flowed to a heat exchanger 40. After going through the heat exchanger 40, that same fluid 17, plus some additional fluid 25, including but not limited to water and/or other infrared-emitting materials, can be flowed back to the cooling panel stack 12 to be cooled again. Alternatively, or additionally, the fluid 17, and, optionally, some additional fluid 25, can be directed to other locations. For example, in some embodiments, the heat transfer fluid 17, and, optionally, some additional fluid 25, can flow to a storage tank or thermal storage tank after flowing through the cooling panel stack 12. In some embodiments, the additional fluid 25 can be refrigerant flowing through a refrigerant loop (e.g., from the exit of the heat exchanger 40, to the expansion valve 95, to the evaporator 96, to the compressor 97, and back to the condenser 94). The refrigerant can be cooled in the heat exchanger 40 and/or at any other point along the refrigerant loop via the cooled heat transfer fluid 17 and then sent through the system back to the condenser 94, as shown in FIG. 3.

The use of a portion of the evaporative layer 28 as at least part of the heat transfer fluid 17 can be done in lieu of or in addition to introducing heat transfer fluid 17 from outside of the cooling panel stack 12, such as, for example, from the air conditioning unit 94. Fluid 17 introduced from outside of the cooling panel stack 12 can be delivered and then directed out of the stack 12 using any techniques or materials known to those skilled in the art, including one or more conduits 18, 20. In some embodiments, hotter fluid 17 may enter through a first conduit 18 on an inlet end of the panel stack 12, and a second conduit 20 can direct cooled fluid 17 out of an output end of the panel stack 12, as shown in FIG. 2A (and in FIGS. 2B and 2C, using their respective reference numerals).

Figure 2D:
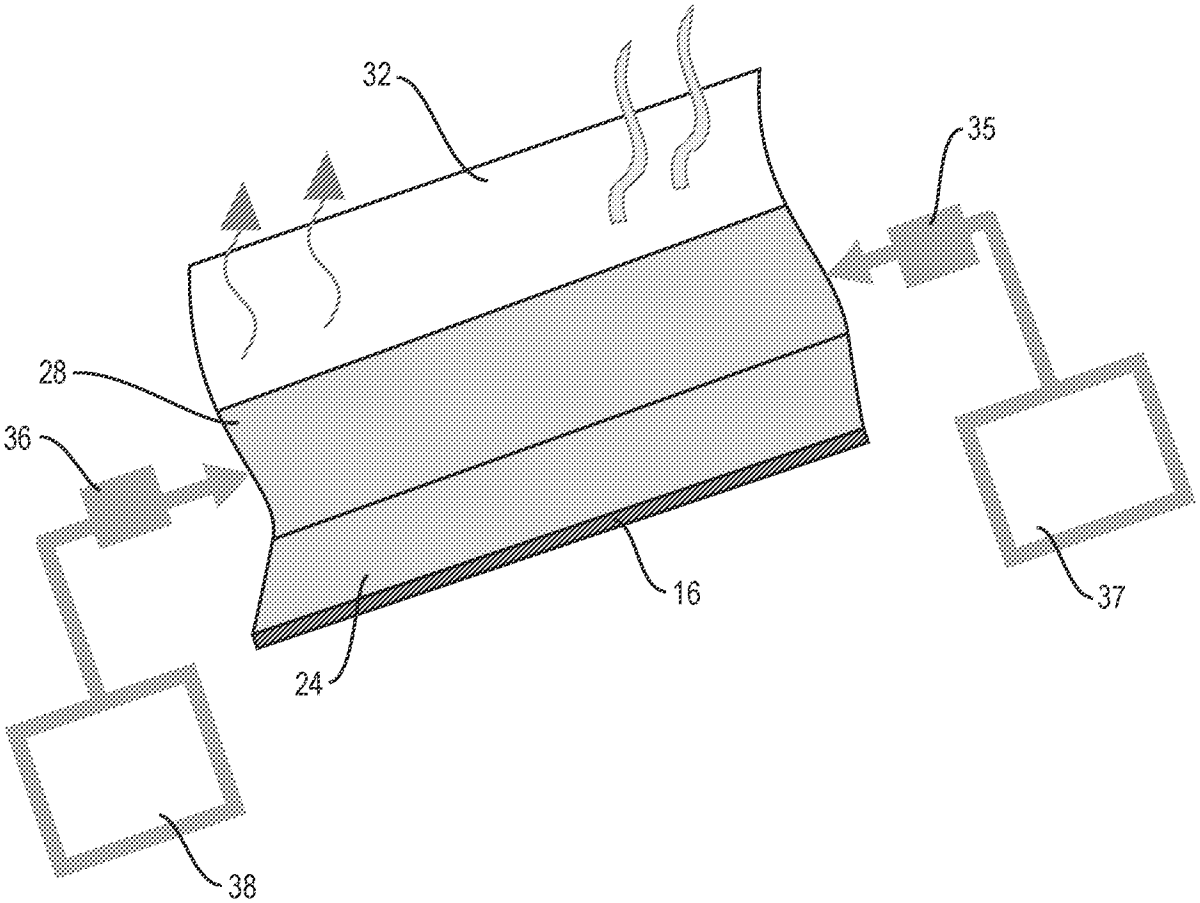
FIG. 2D is a side schematic view of a further alternative hybrid evaporative and radiative cooling panel system including capillary pumps.

Illustratively, during continuous operation of the cooling panel stack 12, the evaporating fluid (e.g., water) within the evaporative layer 28 can be replenished by capillary pumping from the bottom or sides of the panels (such as when using porous materials, including but not limited to hydrogels), or by having a continuous water film flowing as part of the evaporative layer 28 using a pump and/or gravitational force, or through a combination of capillary action and active pumping. By way of non-limiting example, FIG. 2D illustrates pumps 35, 36 configured to pump water from liquid reservoirs 37, 38 into opposing sides of the evaporative layer 28.

In some exemplary embodiments, the ERCP system 10 may be configured to be connected to an expansion valve 95 downstream of the heat exchanger 40, which may be considered a component of the condenser 94 or of the ERCP system 10 itself. The heat exchanger 40 can be arranged, for instance, between the compressor 97 and the condenser 94, or between compression stages of the compressor 97. The ERCP system 10 can further include an evaporator 96 downstream of the expansion valve 95, and a compressor 97 downstream of the evaporator 96, the compressor 97 being fluidically connected to the condenser 94 (for example, the air conditioning unit 94). In some embodiments, refrigerant can flow through the refrigerant loop (e.g., condenser 94 to heat exchanger 40, to the expansion valve 95, to the evaporator 96, to the compressor 97, and back to the condenser 94) and be cooled in the heat exchanger 40 via the cooled heat transfer fluid 17. A person skilled in the art will understand a variety of other configurations that are possible in view of the present disclosures, for example, the heat exchanger 40 can be arranged along the refrigerant loop between any of the components 94, 95, 96, 97.

In some embodiments, the system shown in FIG. 3 may not include the condenser 94, the expansion valve 95, and/or the compressor 97, and instead the heat exchanger 40 of the ERCP system 10 can be utilized at the position of the evaporator 96 such that the system 10 directly interacts with, for example, an air system of a building. In such embodiments, the heat exchanger 40 can directly exchange heat between the heat transfer fluid loop (e.g., between the heat exchanger 40 and the cooling panel stack 12) and the air in the building.

The advantage of using the hybrid cooling panel stack 12 at the condenser side can be better understood by looking at the pressure-enthalpy diagram of a refrigeration cycle, as shown in FIG. 4. Illustratively, the hybrid cooling panel stack 12 can lower the condensation temperature of the refrigerant (from 2-3 to 2'-3'), thus reducing the maximum refrigerant pressure and the compressor 97 work. In such an approach, the air-cooled condenser 94 may, in at least some instances, only be used to provide desuperheating of the refrigerant and/or other material disposed in the condenser 94. In some embodiments, the hybrid cooling panel stack 12 can provide refrigerant subcooling (3' to 3"), delivering additional cooling (4'-4) at the evaporator 96 side for a constant compressor 97 work. In such an approach, the air-cooled condenser 94 can be used for the whole condensation heat rejection. Depending on the heat rejection capacity of the cooling panel stack 12 at a given temperature relative to the ambient, one of these two approaches can provide higher energy savings than another. More specifically, refrigerant subcooling can be more appropriate for lower cooling panel heat rejection capacity while the reduced condensation temperature can provide higher energy savings for higher cooling panel heat rejection capacity. Refrigerant subcooling can enable more cooling per mass flow rate of refrigerant and per compressor 97 work, reducing energy consumption. In some embodiments, the cooling panel stack 12 can provide a combination of both approaches, including providing refrigerant cooling for condensation and subcooling.

In some embodiments, the solar reflecting layer 24 can include, but is not limited to, white paint, metallic film, a porous polymeric layer, a metamaterial layer, multilayer polymeric film, or the like. The evaporative layer 28 can include, but is not limited to, polyacrylamide hydrogel (PAH), a thin film of water, or the like. In some embodiments, the evaporative layer 28 is porous. The insulation layer 32 can include, but is not limited to, polyethylene aerogel (PEA), porous polyethylene, polyethylene fabric, or the like. In some embodiments, the evaporative layer 28 is porous. One or more of the layers 16, 24, 28, 32 of the ERCP 10 as provided for herein can be combined into a single, integrated layer. For example, a single, integrated layer can include a solar reflecting layer 24 and a water layer and an infrared-emitting layer, defining an evaporative layer 28, combined into a single layer. Provided the desired properties can be maintained, the layers 16, 24, 28, 32 can be configured in manners that can be mixed and matched as would be understood and determinable by a person skilled in the art in view of the present disclosures.

A person skilled in the art will also understand that the hybrid cooling panel stacks provided for herein, including those of the ERCP system 10, the ERCP system 10', the ERCP system 10", the ERCP system 210, and the ERCP system 310, or otherwise derivable from the present disclosures, do not need to be on the rooftop of a building. In some embodiments, the panel stacks can be located in any suitable outdoor location and facing the sky in at least some fashion. For example, the panel stacks can be oriented horizontally, at an angle, or vertically. In some embodiments, the panel stacks can be oriented so as to slightly tilt away from the southern direction when in the Northern hemisphere (i.e., sunlight facing side), so as to aid in minimizing solar heating, and in the opposite manner when in the Southern hemisphere. The panel stacks can also be tilted slightly towards the sunlight in some embodiments. Moreover, the panel stacks can also be utilized in partial sunlight, including obstructed and shaded scenarios. Non-limiting examples of where they may be located when they are outside include a parking lot, on a field, on the walls of a building, etc. Moreover, it is noted that, although the remaining descriptions of the ERCP systems 10, 210, 310 may not directly reference the configurations of systems 10', 10", a person skilled in the art will appreciate that the descriptions of the systems 10, 210, 310 and their associated functionality and advantages are typically applicable to the other configurations of systems 10', 10".

Figure 5B:
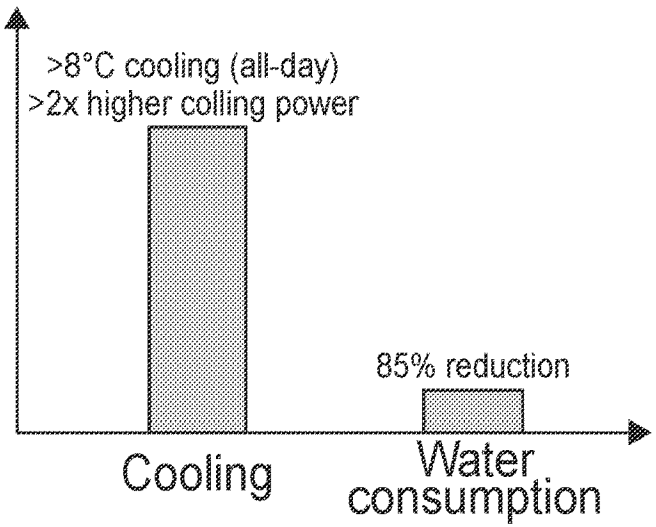
FIG. 5B is a graph showing cooling and water consumption of the experimental system of FIG. 5A.
Figure 5A:
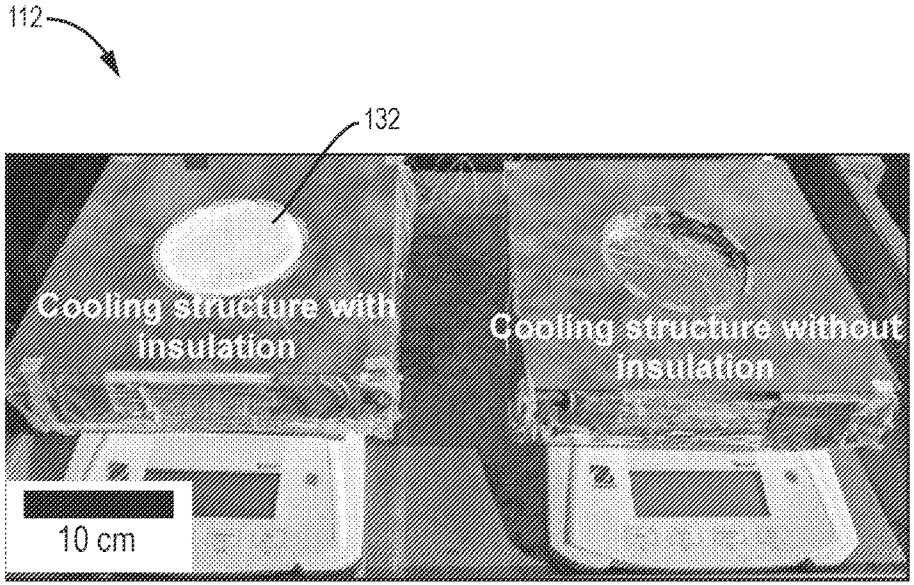
FIG. 5A is a perspective view of an experimental setup of the hybrid evaporative and radiative cooling panel system of FIG. 2A utilized to carry out an experimental study of the system.

Initial lab-scale outdoor cooling performance was demonstrated with a proof-of-concept hybrid evaporative-radiative cooler panel stacks 112, 112' illustrated by the experimental setup shown in FIG. 5A. This experimental setup was designed to simulate results achievable by the ERCP systems described herein, including the systems 10, 10', 10" described above and shown in FIGS. 2A-2C, as well as the systems 210, 310 described below. As such, a person skilled in the art will appreciate that the stacks 112, 112' includes similar components as the ERCP systems described herein, including a solar reflector, an evaporative layer, and, for the stack 112, an insulation layer 132. Temperatures significantly below (approximately greater than 8° C.) the ambient all day long were achieved with the experimental setup, even below the wet-bulb temperatures, which is not possible with previous evaporative cooling techniques. Compared to radiative cooling, the cooling power was doubled. By adding the insulation layer 132, which is akin to the insulation layer 32 shown in FIG. 2A, the water expenditure for hybrid cooling was cut by approximately 85%. As shown in FIG. 5B, a temperature of approximately 8° C. below the ambient temperature without electricity was achieved, showing that the experimental system doubled the cooling power of previous radiative cooling techniques, and showing that, with insulation, the evaporated water mass was cut by approximately 85%. Additional design characteristics and experimental analysis will be described in greater detail below.

Figure 6:
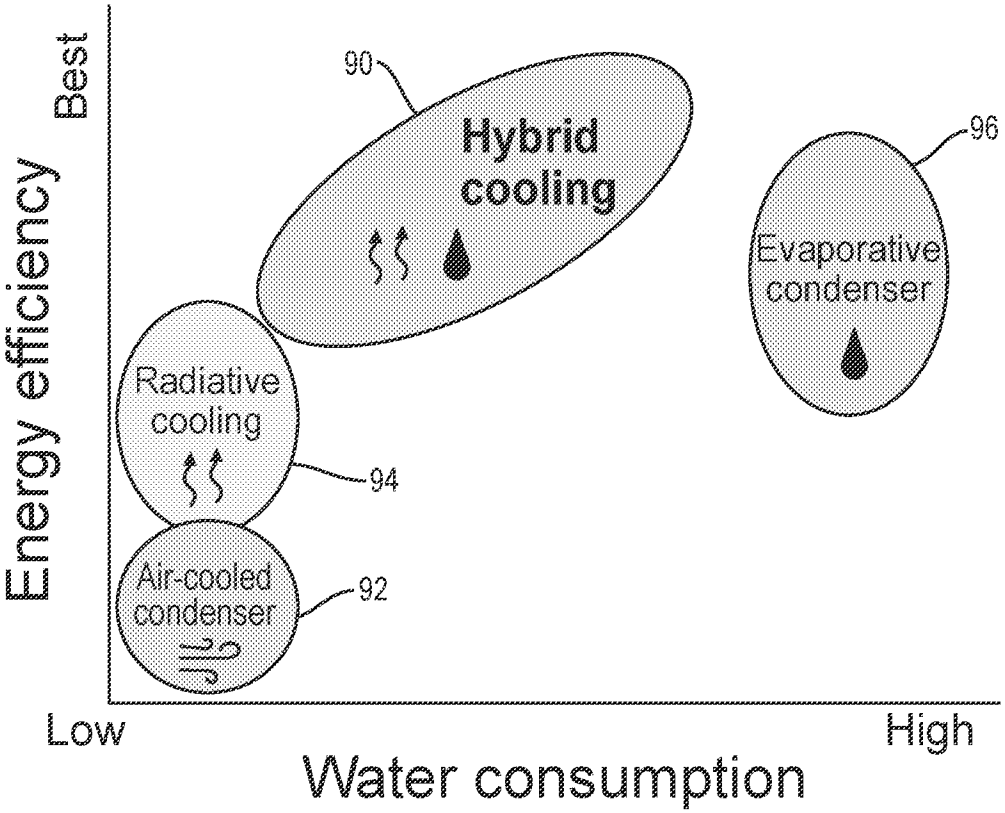
FIG. 6 is a graphical representation of a qualitative comparison between different condenser cooling technologies.

FIG. 6 qualitatively compares hybrid cooling using the described ERCP system 10 and other similar systems disclosed herein or otherwise derivable from the present disclosures, identified by systems 90 in the graph, to existing condenser cooling technologies, identified by air-cooled condenser systems 92, radiative cooling systems 94, and evaporative condensers 96. The metrics used in the comparison are two key ones for evaluating the performance of such systems—water usage (x-axis) and the resulting energy efficiency (y-axis). Most commonly, condensers are air-cooled with large fans rejecting heat to the ambient, having to operate at temperatures considerably above the ambient. The performance of such systems is the air-cooled condenser systems 92. Existing radiative cooling panels have improved to reduce the condenser temperature without additional water usage. However, the relatively low cooling power limits their energy efficiency improvement, as shown by the radiative cooling systems 94 placement on the graph. On the other hand, condensers cooled by pure evaporation can reach much lower temperatures and provide high energy savings, however, at the cost of rather large water expenditure, as shown by the evaporative condenser systems 96 placement on the graph. The disclosed hybrid cooling panel stack 12 of the ERCP system 10, and other stacks and systems provided for herein or otherwise derivable from the present disclosures, dissipates heat with both thermal radiation and water evaporation, achieving better cooling than standalone technologies. The dual-cooling mode largely cuts water consumption, which can be further managed by varying the insulation thickness. Thus, as shown in the graph of FIG. 6, hybrid cooling systems 90 provide better efficiency than each of the systems 92, 94, and 96, while also minimizing water consumption, significantly outperforming the most efficient of the older systems, evaporative condenser systems 96, with respect to water consumption. Additional advantages, improvements, and potential usage scenarios will be described in greater detail below.

Insulation Layer and Evaporative Layer Composition and Analysis

Figure 7B:
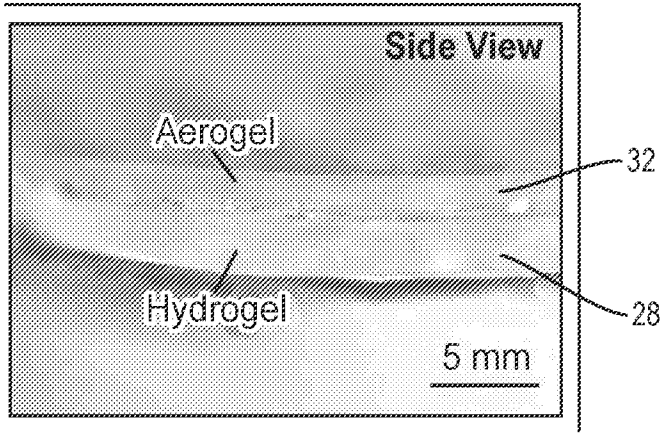
FIG. 7B is a side view of the hydrogel evaporative layer and the aerogel insulation layer of FIG. 7A.
Figure 7A:
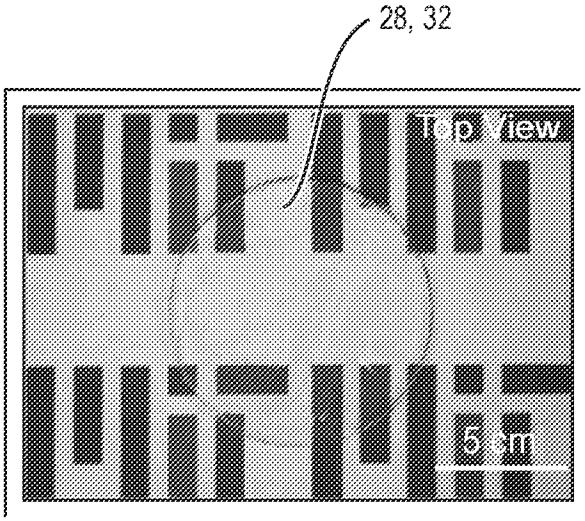
FIG. 7A is top view of a hydrogel evaporative layer and an aerogel insulation layer of the cooling panel system of FIG. 2A.

The following evaporative and insulation layers 28, 32, sometimes referred to as an evaporation-insulation bilayer, are exemplary and may be utilized in a variety of cooling scenarios. For example, the evaporative and insulation layers 28, 32 described in this section produced unexpectedly superior cooling performance in an indoor setting as opposed to other settings. This cooling set-up can be different than the ERCP system described above. In at least some exemplary embodiments, the insulation layer 32 can be comprised of aerogel and the evaporative layer 28 can be comprised of hydrogel. By way of a non-limiting example, the aerogel of the insulation layer 32 can include synthesized hydrophobic silica aerogels with approximately 95% porosity and approximately half the thermal conductivity of air. Also by way of a non-limiting example, the hydrogel of the evaporative layer 28 can be prepared by free radical copolymerization of acrylamide and 2 acrylamido 2 methylpropan sulfonic acid. The non-limiting examples of the aerogel and hydrogel are illustrated in FIGS. 7A and 7B.

Figure 7D:
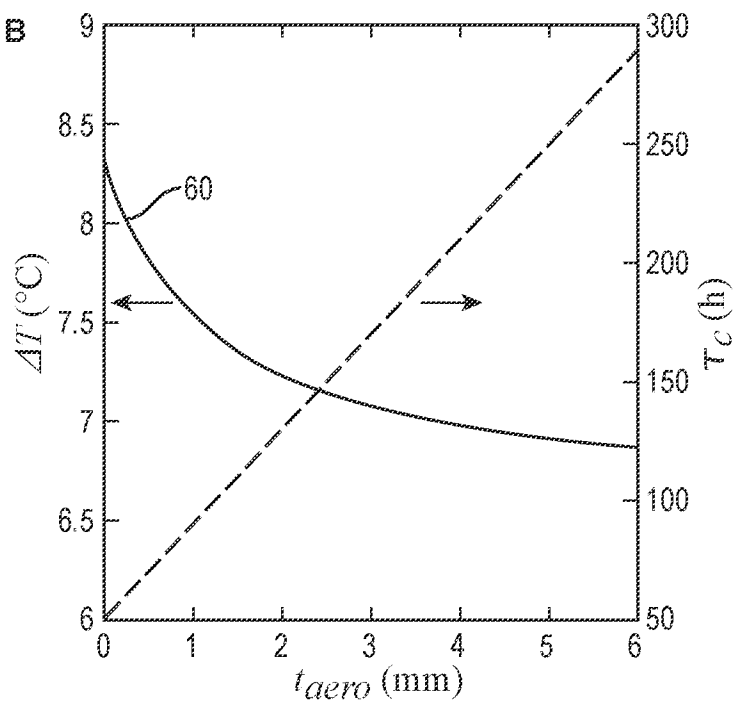
FIG. 7D is a graph of temperature drop from the ambient and effective cooling time as a function of the aerogel insulation layer thickness associated with FIG. 7C.
Figure 7C:
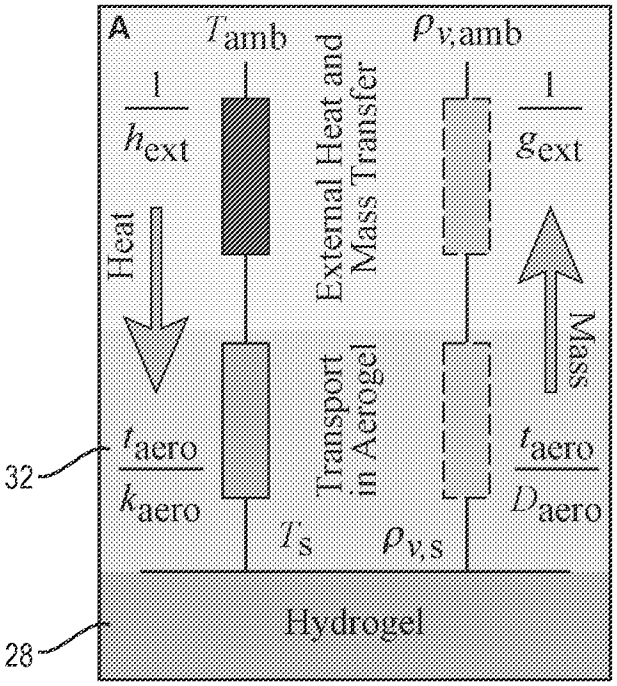
FIG. 7C is a schematic view of a resistance network of heat and mass transfer between the hydrogel evaporative layer and an ambient surrounding environment of FIG. 7A.

To understand the working principle of the bilayer structure, both heat and mass transfer in the system are considered. In FIG. 7C, an evaporative mass flow is driven by the difference between the vapor mass density at the hydrogel surface $\rho_{v,s}$ and that in the ambient $\rho_{v,amb}$, where $\rho_{v,s}$ is determined as the saturation vapor density at the hydrogel temperature $T_s$. The overall mass transfer resistance includes the diffusion resistance in the aerogel $t_{acro}/D_{acro}$ and the mass convection resistance $1/g_{ext}$, where $t_{aero}$ is the aerogel thickness, $D_{aero}$ is the effective vapor diffusivity in the aerogel, and $g_{ext}$ is the mass transfer coefficient for external convection. The mass flux across the system j is then given by Equation (1):

$$j\left(\frac{t_{aero}}{D_{aero}}+\frac{1}{g_{ext}}\right)=\rho_{v,s}-\rho_{v,amb}. \tag{1}$$

In contrast, the temperature difference between the ambient and the hydrogel generates an inward heat flow. The overall thermal resistance in the system comprises the external thermal resistance $1/h_{ext}$ and the thermal resistance across the aerogel $t_{aero}/k_{aero}$, where $h_{ext}$ is the effective heat transfer coefficient accounting for both convection and radiation, and $k_{aero}$ is the effective thermal conductivity of the aerogel. Combining these two resistances, the heat flux across the system q then follows Equation (2):

$$q\left(\frac{t_{aero}}{k_{aero}}+\frac{1}{h_{ext}}\right)=T_{amb}-T_s \tag{2}$$

where $T_{amb}$ is the ambient temperature.

$D_{aero}$ was characterized using the wet cup method following ASTM E96, and $k_{aero}$ was measured based on the guarded hot plate method following ASTM C1044 16. It is noted that $k_{aero}$ represents the effective thermal conductivity, which incorporates heat conduction, convection, and radiation within the aerogel, i.e., the insulation layer 32. Accordingly, $D_{acro}$=0.039±0.03 $cm^2$Is and $k_{aero}$=13+2 mW/m K. Meanwhile, $g_{ext}$ and $h_{ext}$ are related to sample geometries and working conditions, which have also been calibrated. Energy balance can be quantified by Equation (3):

$$q=jh_{fg} \tag{3}$$

In this equation, $h_{fg}$ is the enthalpy of vaporization of water in the hydrogel, or the evaporative layer 28. Equations (1), (2), and (3) have three unknowns: $T_s$, q, and j, from which the temperature drop of the hydrogel can be determined from the ambient ΔT, $T_{amb}$, $T_s$. Also, the effective cooling time $\tau_c$ can be determined from mass conservation, given a certain hydrogel thickness $t_h$ (Equation 4):

$$\rho_h t_h \omega = j\tau_c \tag{4}$$

In this equation, $\rho_h$ and ω are the density and the water mass fraction of the hydrated hydrogel, respectively. ΔT and $\tau_c$ are the two important performance metrics of the cooling system. In FIG. 7D, they are plotted as functions of the aerogel insulation layer 32 thickness $t_{aero}$ for a reference working condition, where $T_{amb}$=30° C. and the ambient relative humidity RH=40% with $f_h$=5 mm. Under this reference working condition, $g_{ext}$=3.9 mm/s and $h_{ext}$=8.1 W/$m^2$ K. As the aerogel insulation layer 32 increases thickness, ΔT (line 60) becomes smaller because the aerogel insulation layer 32 creates additional vapor transport resistance for evaporation. For relatively large $t_{aero}$, ΔT decreases less sharply as the thermal insulation effect of the aerogel insulation layer 32 plays a more significant role. The increased $t_{aero}$ reduces the environmental heat gain while distributing the cooling capacity over a longer time. As a result, $t_c$ increases with larger $t_{aero}$.

A person skilled in the art will appreciate that the temperature variation in the hydrogel evaporative layer 28 is neglected, as the thermal conductivity of the hydrogel evaporative layer 28 is much larger than $k_{aero}$. Consequently, ΔT is not sensitive to $t_h$, and $t_c$ is simply proportional to $t_h$ based on Equation 4. The thermal contact resistance between the hydrogel and the aero gel has also been neglected since this thermal resistance is much smaller than that of the aerogel insulation layer 32.

Figure 8B:
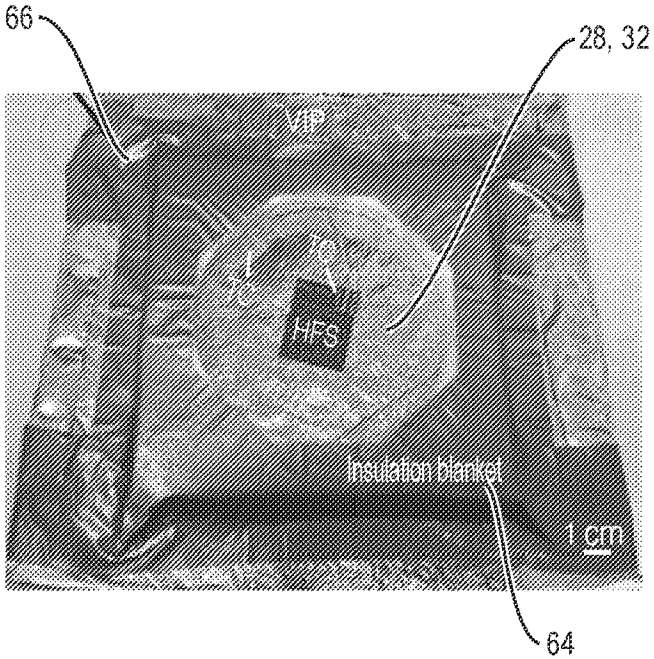
FIG. 8B is a top perspective view of the experimental setup of FIG. 8A.
Figure 8A:
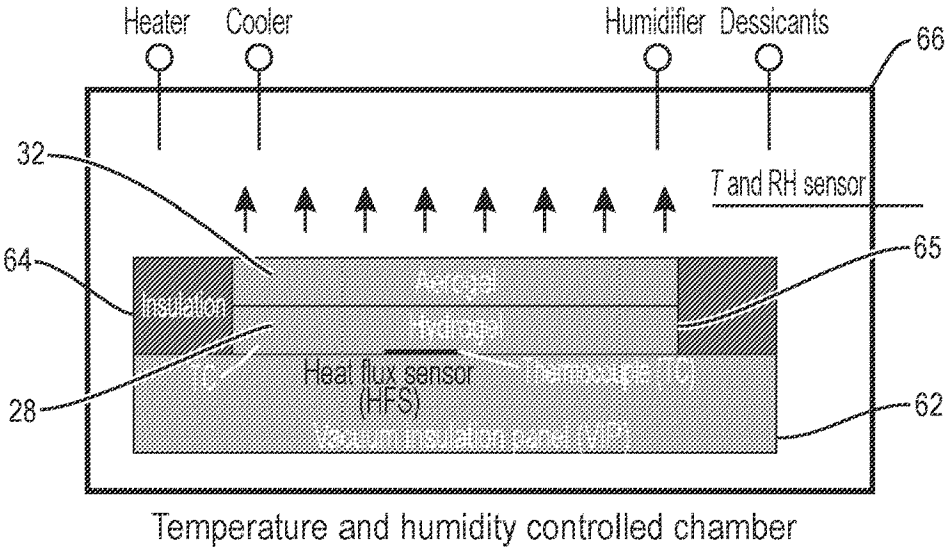
FIG. 8A is a schematic view of an experimental setup used to test the hydrogel evaporative layer and the aerogel insulation layer of the cooling panel system of FIG. 7A.

To validate the above model framework, an experimental study was conducted in which a proof-of-concept experimental setup was built, as shown in FIGS. 8A and 8B. A 10 cm diameter test sample of the hydrogel evaporative layer 28 and the aerogel insulation layer 32 was put on top of a vacuum insulation panel 62 and side insulation 64 was made of an aerogel insulation blanket (08-052 gel, HiwowSport). An inner surface 65 of the insulation blanket 64 was covered with a Kapton polyimide film to prevent sideways evaporation. The whole test fixture was then placed in an environmental chamber 66 where $T_{amb}$ and RH were controlled, as shown schematically in FIG. 8A and physically in FIG. 8B.

Figure 9:
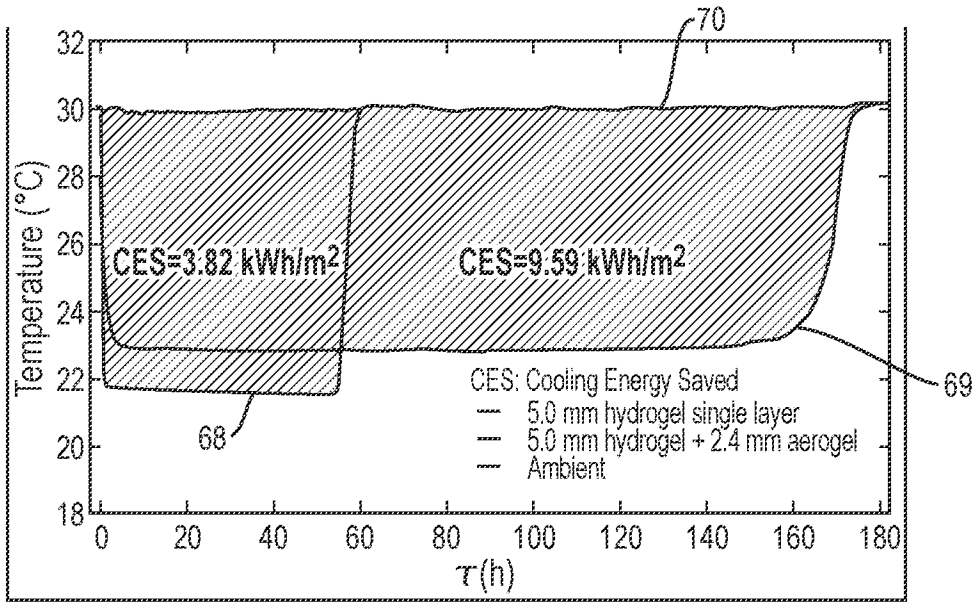
FIG. 9 is a graph of cooling curves of the hydrogel evaporative layer and the hydrogel evaporative layer plus the aerogel insulation layer of FIG. 7A.

During the experiments, first, the top surface was covered to prevent evaporation and allowed the sample to equilibrate with the environment. Then, the top cover was removed and the temperature response of the sample with thermocouples was monitored. In this manner, the temperature regulation is not aided by the thermal capacity of the test fixture. The accuracy of the ΔT measurement is +/−0.2° C. and the error for RH is +/−2%. Typical cooling curves as a function of time r are shown in FIG. 9. Two samples were tested at the same time: Sample 1 with about 5.0 mm of hydrogel (line 68 in the graph) and Sample 2 with about 5.0 mm of hydrogel plus about 2.4 mm of aerogel (line 69 in the graph). As soon as evaporation started at τ=0, the temperature of both samples quickly decreased from the ambient (line 70 in the graph). As predicted by the model, Sample 1 reached a lower steady state temperature, while Sample 2 lasted for a much longer time.

Prior to the experiment, the water mass fraction of the hydrated hydrogel was about 98% as determined by thermogravimetric analysis. After drying the hydrogel evaporative layer 28, the mass loss data indicated that about 97% of the original water mass evaporated after one cooling cycle. During the cooling time, the average mass flux leaving the sample was about 0.10 kg/m$^2$ h for Sample 1, which is equivalent to an evaporation cooling flux of about 69 W/m$^2$. For Sample 2, the average mass flux was about 0.034 kg/m$^2$ h, which corresponds to an evaporation cooling flux of about 23 W/m$^2$. Indeed, the evaporation rate is lower for the design having the hydrogel evaporative layer 28 and the aerogel insulation layer 32.

Figure 10B:
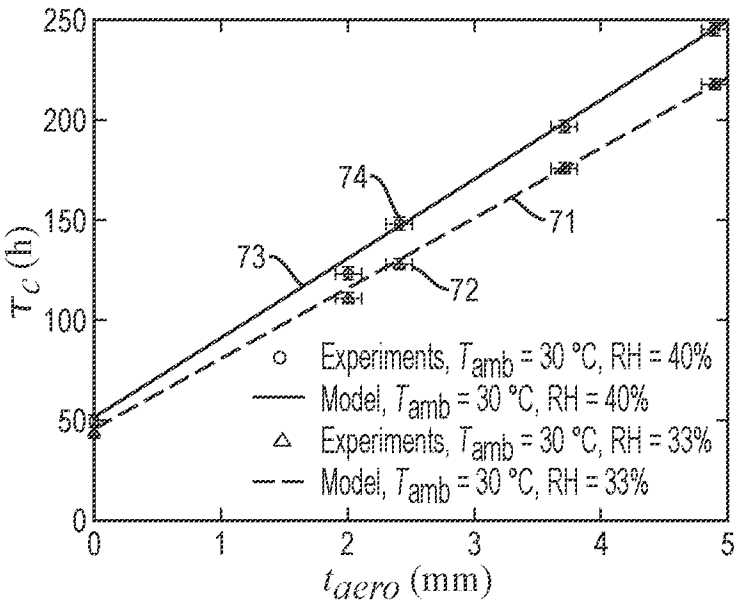
FIG. 10B is a graph of $\tau_c$ versus $t_{aero}$ for the hydrogel evaporative layer plus the aerogel insulation layer of FIG. 7A.
Figure 10A:
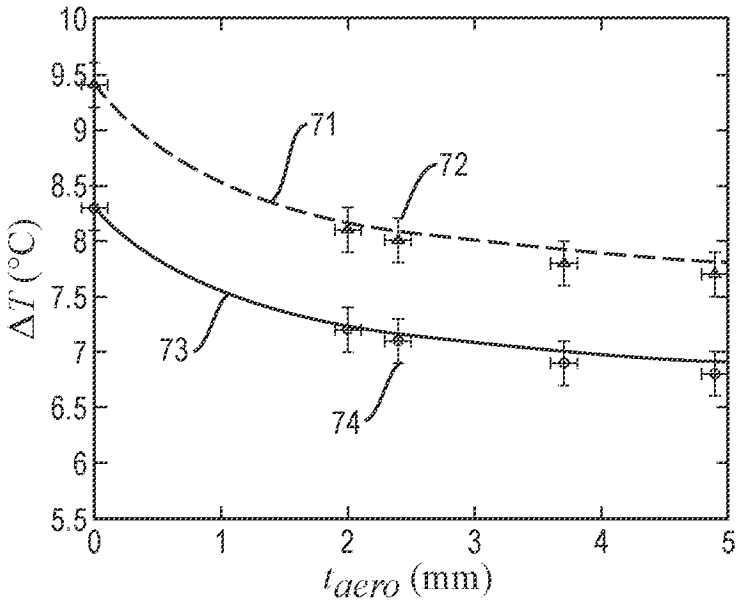
FIG. 10A is a graph of ΔT versus fuero for the hydrogel evaporative layer plus the aerogel insulation layer of FIG. 7A.

A so called "temperature burden" is defined as the area under the ambient temperature curve for the two samples (A1 and A2). If Sample 2 lasted longer merely because evaporation was slower, it would be expected that A1 is approximately equal to A2. However, the values obtained with the combined hydrogel evaporative layer 28 and the aerogel insulation layer 32 were A1=about 471.5° C./h and A2=about 1183.7° C./h, indicating that the insulation layer 32 did more than just redistribute the evaporative cooling capacity. From FIG. 9, ΔT and $\tau_c$ can be extracted. FIGS. 10A and 10B show ΔT and $\tau_c$ as functions of $t_{aero}$ for select RH values. More particularly, as shown, modeled data for $T_{amb}$ being 30° C. with RH being 40% is shown as a line 71 in both figures, and experimental data for those same parameters is shown as data points 72 in both figures, with each data point allowing for typical standard deviations as illustrated by lines extending in either direction from the data points 72. Further, modeled data for $T_{amb}$ being 30° C. with RH being 33% is shown as a line 73 in both figures, and experimental data for those same parameters is shown as data points 74 in both figures, with each data point allowing for typical standard deviations as illustrated by lines extending in either direction from the data points 74.

Good agreement is found between the experimental data and the model. Notably, under the reference working conditions, when $t_{aero}$=5 mm, combined hydrogel evaporative layer 28 and the aerogel insulation layer 32 can extend the by about 400%, while only sacrificing the temperature drop by about 1.5° C. compared with the conventional single layer design. In some embodiments, given a ΔT requirement, the aerogel insulation layer 32 thickness can be optimized such that it is thin enough to reach a low enough temperature, while being as thick as possible to extend the cooling time. In some embodiments, in particular in which the aerogel includes pores, the size of the pores can affect the efficiency of the cooling panel stack 12. In some embodiments, the size of the pores can be adjusted to increase or decrease the efficiency of the cooling panel stack 12.

Figure 11B:
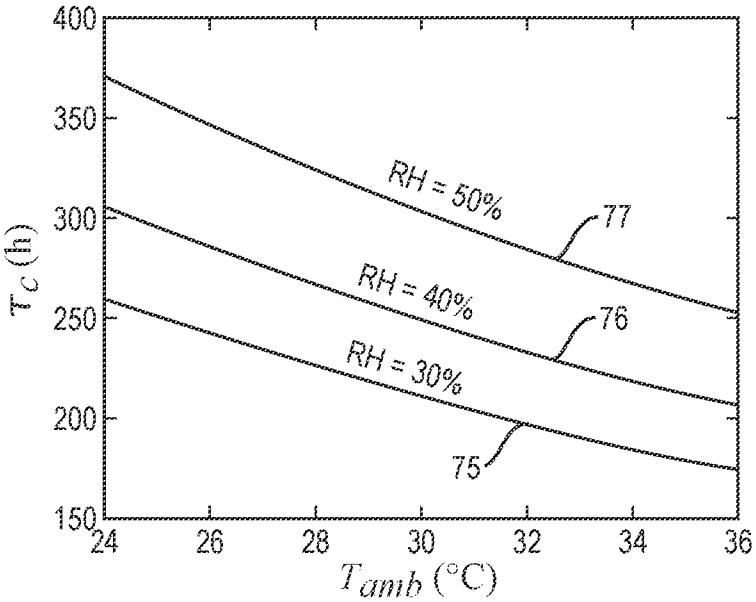
FIG. 11B is a graph of $\tau_c$ versus $T_{amb}$ for the hydrogel evaporative layer plus the aerogel insulation layer of FIG. 7A for RH=30% based on the disclosed heat and mass transfer model.
Figure 11A:
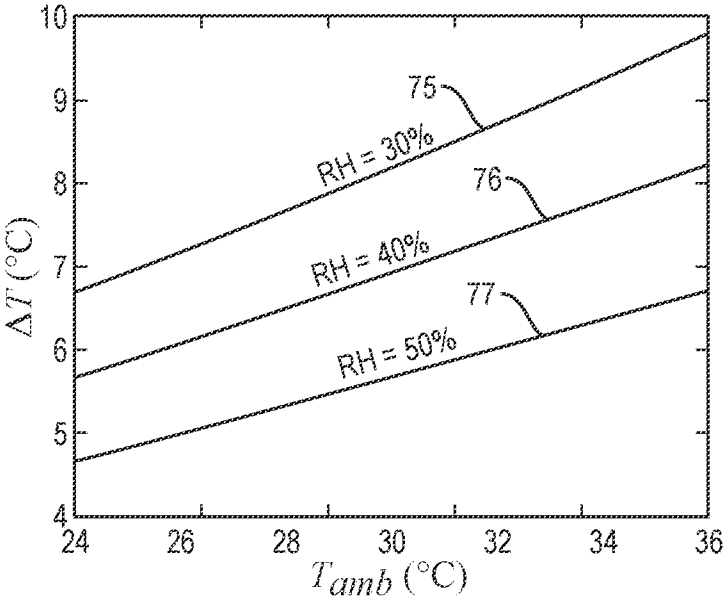
FIG. 11A is a graph of ΔT versus $T_{amb}$ for the hydrogel evaporative layer plus the aerogel insulation layer of FIG. 7A for RH=30% based on the disclosed heat and mass transfer model.

With the validated heat and mass transfer model, the effect of environmental conditions can be investigated. As shown in FIGS. 11A and 11B, ΔT and $\tau_c$ are plotted as functions of the ambient temperature for select values of RH, fixing $t_h$ and $t_{aero}$ at 5 mm. The evaluated values of RH for the graphs in both FIGS. 11A and 11B was RH=30%, as illustrated by line 75, RH=40%, as illustrated by line 76, and RH=50%, as illustrated by line 77. Because the saturation vapor density increases sharply with temperature as $T_{amb}$ becomes higher, there is more pronounced evaporation, leading to larger temperature drops and shorter total evaporation time. In contrast, when the RH is increased, the vapor density difference between the hydrogel evaporative layer 28 surface and the ambient decreases. As a result, evaporation becomes slower, which gives rise to smaller ΔT and longer $\tau_c$.

To gain more insights into this cooling design, consideration is given to the case where $t_{acro}/D_{acro} >> 1/g_{ext}$ and $t_{acro}/k_{acro} >> 1/h_{ext}$. Then, dividing Equation (2) by Equation (1), the following Equation (5) is obtained:

$$h_{fg}\frac{D_{aero}}{k_{aero}} \approx \frac{\Delta T}{\rho_{v,s} - \rho_{v,amb}} \tag{5}$$

The right side of Equation (5), where $h_{fg}$ is located, is a monotonically increasing function of ΔT, while the left side, where ΔT is located, is independent of $t_{aero}$. This is why ΔT varies little for larger fuero in the data shown in FIG. 10B. In this regime, ΔT increases with $D_{aero}/k_{aero}$ and the cooling time can be increased with thicker aerogel insulation layers 32 without much penalty in the temperature drop. However, in packaging applications, the total thickness of the cooling layer is often limited.

Figure 12B:
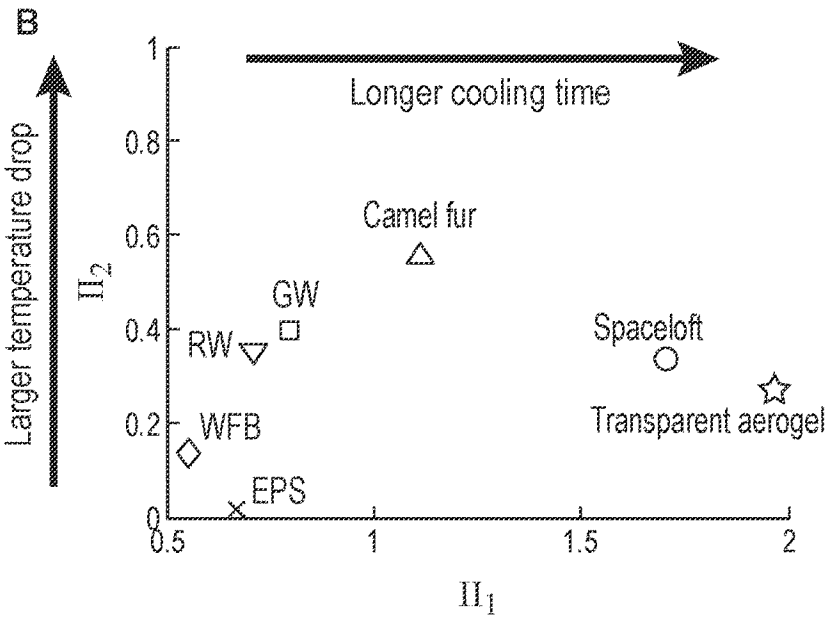
FIG. 12B is a graph showing key properties of select insulation materials, including known materials and the aerogel insulation layer of the present disclosures.
Figure 12A:
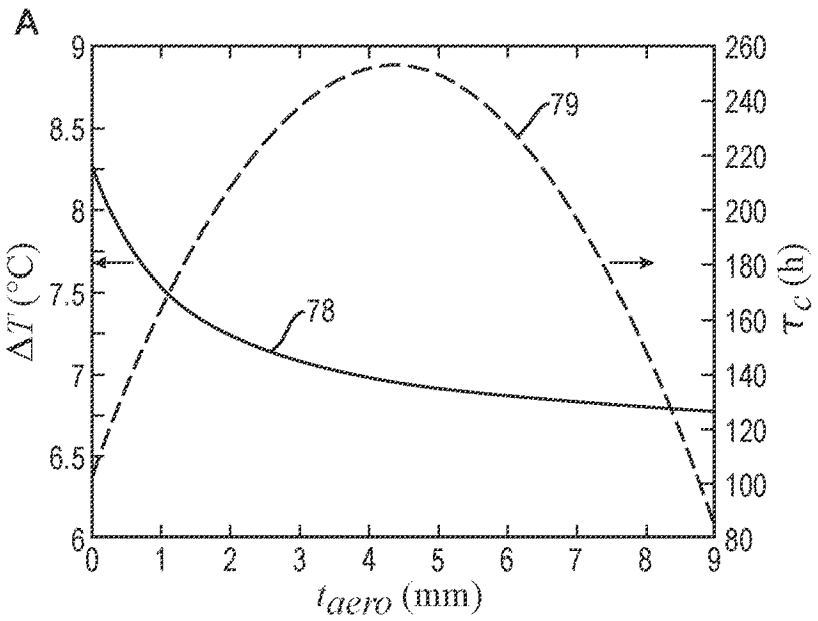
FIG. 12A is a graph of ΔT versus $t_{aero}$ for the hydrogel evaporative layer plus the aerogel insulation layer of FIG. 7A for $T_{amb}$=30° C., RH=40%, and total thickness of the two layers being approximately 10 millimeters.

FIG. 12A shows the model results from Equations (1), (2), (3), and (4) for ΔT, as shown by line 78, and $\tau_c$, as shown by line 79, as functions of $t_{aero}$ for $T_{amb}$=30° C., RH=40%, restricting $t_{tot}=t_h+t_{aero}$=10 mm. The ΔT curve is the same as the one in FIG. 7D as it is not typically sensitive to the hydrogel thickness. In contrast, the first increases as $t_{aero}$ becomes larger due to slower evaporation and better insulation. However, as $t_{aero}$ further increases, the cooling time is shorter because of the decreasing hydrogel thickness. Furthermore, multiplying Equations (2) and (4), the following Equation (6) is obtained:

$$\tau_c = \frac{\rho h^{\omega h} fg}{k_{aero}\Delta T} t_h \left(t_{aero} + \frac{k_{aero}}{h_{ext}}\right) \tag{6}$$

For the insulation layer to function properly, $t_{tot}/k_{aero}$ is usually set to be much larger than $1/h_{ext}$ (in this reference case, $t_{tot}/k_{aero}$ 6.1/$h_{ext}$). As $t_h+t_{aero}$ tot is restricted, the right side of Equation (6) becomes a quadratic function of $t_{aero}$ and takes the maximum near $t_{aero}$ $t_{tot}/2$, noting that ΔT is not sensitive to $t_{aero}$ around $t_{tot}/2$. In FIG. 12A, the peak of $\tau_c$ appears around $t_{aero}$=5 mm, which supports the reasoning above. Moreover, the maximum of the should approximately scale with $1/k_{aero}$ based on Equation (6). Accordingly, the performance metrics ΔT and the related to two sets of material properties $D_{acro}/k_{acro}$ and $1/k_{acro}$, respectively, are determined.

FIG. 12B shows these properties for select insulation materials, as shown expanded polystyrene (EPS, and labeled as such in the graph), wood fiberboards (WFB, and labeled as such in the graph), rock wool (RW, and labeled as such in the graph), glass wool (GW, and labeled as such in the graph), camel fur (labeled as "Camel fur" in the graph), and an aerogel blanket from Spaceloft (labeled as "Spaceloft" in the graph), as well as a transparent aerogel of the present disclosure (labeled as "Transparent aerogel" in the graph). The x-axis $\Pi_1$ is the inverse of thermal conductivity normalized to $1/k_{air}$ at 25° C., which is related to the and the y-axis $\Pi_2$ is the ratio between the vapor diffusivity and the thermal conductivity normalized to $D_{air}/k_{air}$ at 25° C., which is related to ΔT. Here, $k_{air}$ and $D_{air}$ are the thermal conductivity of static air and the vapor diffusivity in air, respectively.

Notably, camel fur excels in the vapor diffusivity to thermal conductivity ratio and provides significant thermal resistivity at the same time. This is important to survival in deserts for camels. A large $\Pi_2$ allows the camel to maintain reasonable body temperatures under hot climates, while a high $\Pi_1$ helps reduce the water expenditure for sweating. After a camel had been closely sheared, the water loss became approximately 50% more compared with a camel with a natural wooly coat. In FIG. 12B, the aerogel insulation layer 32 used in the current study is the only transparent option and is optimized for longer cooling time. For food and pharmaceutical packaging, with the working conditions discussed in FIG. 12A, it has been shown that a combined assembly containing the hydrogel evaporative layer 28 and the transparent aerogel insulation layer 32 can lengthen the cooling time by about 150%, and in some cases up to about 200%, while occupying the same thickness of a typical single layer evaporation structure (ten days instead of four days). Moreover, in extremely humid conditions, safe food storage may still be increased by approximately 40%.

For thermal management of buildings, GW and RW can be readily integrated onto previously developed evaporation-based rooftop cooling systems to form bilayer cooling structures, as will be discussed in greater detail below. Their high $II_1$ ensures a large $\Delta T$, while the cooling time extension can be adjusted by increasing the insulation layer 32 thickness, which is less restricted in building applications. For example, the model suggested that adding 20 mm GW to an existing layer could increase the by 500% under the reference working conditions.

For packaging applications, recharging of hydrogels can be done offline (not necessarily with clean water) when the cooling structure is near dry out. In the case of rooftop cooling of buildings, recharging of hydrogels with rainwater to continuous operation is possible. For the presently disclosed configuration, to apply a similar reloading strategy, additional capillary wicks can be utilized to route the rainwater to the hydrogel evaporative layer 28 underneath the aerogel insulation layer 32. Also, in outdoor applications, solar radiation to the sample and thermal radiation to the sky can play an important role.

Exemplary Embodiment of ERCP System and Analysis

A study was performed on an exemplary embodiment of the ERCP system 10 described above. The cooling tests of the study were performed under unfavorable climate conditions: high atmospheric density and high RH. With scalable materials, stagnation temperatures colder than the wet-bulb temperature (which are not accessible with pure evaporative cooling) were achieved, at about 9.3° C. below the ambient under direct sunlight (solar radiation Qsun=836 W/m$^2$), while the water loss was significantly reduced as the presently disclosed ERCP system 10 properly managed the solar and parasitic heating. Further demonstrated by the study was a net ambient cooling power of about 143 W/m$^2$ at RH=about 44.0% around solar noon (Qsun=772 W/m$^2$) as well as about 202 W/m$^2$ at RH=about 70.2% during the night time. Based on the experimentally validated model, the ERCP system 10 with a practical material set can offer higher cooling powers than even ideal radiative coolers. The study further evaluated the annual cooling electricity savings in buildings. As verified by the study, even in hot and humid climates, the hybrid cooling architecture can cut cooling electricity usage in supermarkets by 9% using only 4% of the rooftop area with small water expenditure, exceeding the energy savings enabled by premium solar panels of the same area.

To elucidate the working principle of the design, the thermal/solar radiation and heat conduction across the cooling architecture are considered, as well as the vapor diffusion through the insulation layer 32. Additionally, the heat and mass convection at the air/insulation layer 32 interface and the reflection and emission at the reflector 24 surface can be incorporated as boundary conditions. The energy balance in the system 10 can be controlled by Equation (7):

$$\frac{d}{dx}(q_{evap} + q_{rad} + q_{cond}) = 0 \tag{7}$$

In this equation, x is the distance from the top surface of the insulation layer 32, $q_{evap}$, $q_{rad}$, and $q_{cond}$ are the energy fluxes associated with evaporation, radiation, and conduction, respectively. While $q_{cond}$ and $q_{evap}$ are governed by Fourier's law and Fick's law, respectively, Grad is determined from the radiative transfer equation (RTE). The RTE accounts for the radiation intensity attenuation due to absorption and out-scattering and the augmentation by emission and in-scattering as well as solar irradiation. More specifically, Equation (7) can be solved for by first discretizing the control volume into L layers and then taking a linear temperature profile T(x) within the system as an initial guess based on the boundary conditions. The temperature profile can then be used within each layer to calculate the divergence of $q_{evap}$, $q_{rad}$, and $q_{cond}$ at the interfaces of each of the L layers, and iteratively update T(x) using a nonlinear solver in MATLAB until Equation (7) is satisfied. Details of the evaporative, radiative, and conductive energy fluxes, as well as cooling power and stagnation temperature calculation details, are given below.

The evaporative energy flux $q_{evap}$ can be driven by the vapor density difference between $\rho_0$ at the evaporation/insulation interface and $\rho_{amb}$ in the ambient air. Here, $\rho_0$ corresponds to the saturation vapor density at the evaporation/insulation interface temperature $T_0$ and $\rho_{amb}$ is characterized by the ambient temperature $T_{amb}$ and RH. The evaporative flow needs to overcome two transport resistances: the first being the mass diffusion resistance in the insulation layer 32 governed by Fick's law and the second being the mass convection resistance at the air/insulation layer 32 interface. Accounting for both resistances, Equation (8) of the evaporative flux $j_{evap}$ obtained:

$$j_{evap} = -\frac{\rho_0 - \rho_{amb}}{\frac{L_{ins}}{D_{ins}} + 1/h_m} \tag{8}$$

In this equation, $L_{ins}$ is the insulation 32 thickness, $D_{ins}$ is the diffusion coefficient of water vapor in the insulation layer 32 (for PEA, it can be experimentally determined as per the wet cup method following ASTM E96), $h_m$ is the mass transfer coefficient at the air/insulation layer 32 interface. The negative sign implies that the net evaporative flow is from the evaporation/insulation 28, 32 interface to the ambient air.

The evaporative energy flux can then be calculated from the evaporative flux, as shown by Equation (9):

$$q_{evap} = j_{evap} h_{fg} \tag{9}$$

In this equation, $h_{fg}$ is the enthalpy of vaporization of water at temperature $T_0$. In the panel stack 12, it can be assumed that the evaporative energy flux is constant across the whole insulation layer 32 and that within the insulation, there is no temperature dependent effect, condensation, or re-evaporation.

The radiative heat flux Grad can be governed by the emission, absorption, and scattering that originate from the atmosphere, the insulation layer 32, the water-rich layer evaporative layer 28, and the substrate underneath (e.g., the reflective layer 24). Grad at can be solved for at each layer of the same control volume using the radiative transfer equation (RTE). The RTE can model the spatial distribution of diffuse intensity of light at both solar and mid-infrared wavelengths by accounting for emission, absorption and scattering in the medium, for given boundary conditions (substrate optical properties and temperature, atmospheric irradiance, solar irradiance) and for the temperature profile T(x) of the medium. The RTE solved for can be given by Equation (10):

$$\mu\frac{dI_\lambda(\tau_\lambda,\mu)}{d\tau_\lambda} = I_\lambda(\tau_\lambda,\mu) - \frac{\omega_\lambda}{2}\int_{-1}^{1} d\mu' p_\lambda(\mu,\mu')I_\lambda(\tau_\lambda,\mu) - (1-\omega_\lambda)B_\lambda[T(\tau_\lambda)] - \frac{\omega_\lambda}{4\pi}F_\lambda^S p_\lambda(\mu,\mu') \tag{10}$$

In this equation, $\lambda$ is the wavelength, la is the diffuse spectral radiance along direction $\mu=\cos(\theta)$ at an optical depth $\tau_\lambda=\int_0^x\beta_\lambda ds$, $\beta_\lambda$ is the extinction coefficient. $\theta$ is the polar angle with respect to the zenith, $\omega_\lambda$ is the scattering albedo, $\rho_\lambda$ is the scattering phase function, $\beta_\lambda$ is the spectral blackbody intensity at a temperature T and optical depth $\tau_\lambda$, and $F_\lambda^s$ is the spectral direct beam source (i.e., solar irradiation). The diffuse radiance direction $\mu$ is defined as positive going from the substrate to the sky. The beam source is assumed to be perpendicular to the medium boundary, which allows simplification of the model by assuming 1-D radiative heat transfer (i.e., azimuthal symmetry). The optical properties (scattering albedo $\omega$, extinction coefficient $\beta$ and scattering phase function p) of the PAH and PEA were estimated from experimental measurements of hemispherical transmittance and reflectance, and direct transmittance.

The current model also accounts for the spatial variation of optical properties with changing medium. The boundary condition at x=0 (air/insulation layer interface) was set by the downward irradiance from the atmosphere modeled in MODTRAN® 6.0 using time and geographical specific weather conditions, which gives Equation (11):

$$I_\lambda(0,-\mu) = I_{\infty,\lambda}(-\mu) \tag{11}$$

In this equation, $I_{\infty,\lambda}$ is the spectral diffuse radiance at the top of the medium (i.e., the atmospheric radiance). At the bottom side of the water-rich layer 28, assumed was reflection and emission from the reflector/emitter 24 at temperature $T_{sub}$, as shown in Equation (12):

$$I_\lambda(\tau_{\lambda,tot},\mu) = \epsilon_\lambda B_\lambda(T_{sub}) + 2\int_0^1 d\mu'\mu'(1-\epsilon_\lambda)I_\lambda(\tau_{\lambda,tot},-\mu) + \frac{F_\lambda^S}{\pi}e^{-\tau_{\lambda tot}}(1-\epsilon_\lambda) \tag{12}$$

In this equation, $\epsilon_1$ is the emitter spectral emissivity and TA, tot is the optical depth at the bottom of the water-rich layer.

To solve for Equation (10) and obtain the diffuse intensity of light within the control volume, the angular domain of the RTE was discretized using the discrete ordinate method, resulting in a linear set of equations which can be more easily solved for. The total radiative heat flux is then calculated by adding the total diffuse and direct fluxes of radiation, as shown in Equation (13):

$$q_{rad}(x) = -\left[2\pi\int_0^\infty\int_1^{-1} I_\lambda(\tau_\lambda(x),\mu)\mu d\mu d\lambda + \int_0^\infty F_\lambda^S e^{-\tau\lambda}d\lambda\right] \tag{13}$$

In this equation, the negative sign implies that the net radiation energy flow goes out of the control volume towards the ambient.

The conductive heat flux $q_{cond}$ is driven by the local temperature gradient and thermal conductivity in the system and is evaluated at each interface of the L layers of our medium. $q_{cond}$ can be solved for using Fourier's law, as shown in Equation (14):

$$q_{cond} = -k\nabla T \tag{14}$$

In this equation, the thermal conductivity k is equal to $k_h$=0.6 W/m-K for PAH and $k_{PEA}$=0.028 W/m-K for PEA. It is noted that $k_{PEA}$ refers only to the solid and gas components of thermal conductivity as the radiative component is captured by the radiative model. In this currently described, non-limiting instance, as part of the boundary conditions, a fixed emitter temperature $T_{sub}$ at the bottom of the water-rich layer 28 was set. At the air/insulation layer 32 interface, thermal convection with the ambient air was assumed with a heat transfer coefficient $h_{conv}$. When modeling the experimental systems, $h_{conv}$ based on the wind speed in the experiments using the empirical relation $h_{conv}$=5.7+3.8V was estimated.

Once the temperature profile T(x) within the system satisfying Equation (7) is found, the evaporative, radiative, and conductive energy flux can be calculated at any location x such as x=0 to evaluate the total cooling power, as shown in Equation (15):

$$q_{cool} = -(q_{evap}(x=0) + q_{rad}(x=0) + q_{cond}(x=0)) \tag{15}$$

By changing the substrate temperature (one of the boundary condition), the cooling power can be evaluated as a function of the temperature difference between the substrate and the ambient and then calculate the stagnation temperature which is defined as the substrate temperature at which $q_{cool}$=0 W/m$^2$.

Returning to the present embodiment, for a given temperature at the substrate surface $T_{sub}$, the hybrid cooling panel stack 12 approach generates cooling power if there is a net energy flow from the substrate to the ambient ($q_{evap}$+$q_{rad}$+$q_{cond}$<0). The net cooling power can then be calculated as shown in Equation (16):

$$q_{cool} = -(q_{evap} + q_{rad} + q_{cond}) \tag{16}$$

The stagnation temperature difference $\Delta T$ is defined as $T_{sub}$-$T_{amb}$ when $q_{cool}$=0 and the net ambient cooling power $q_0$ is defined as $q_{cool}$ at $T_{sub}$=$T_{amb}$.

Figure 13B:
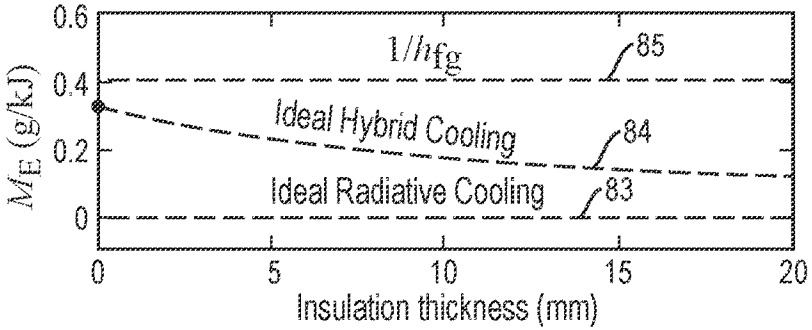
FIG. 13B is a graph showing water usage per cooling power generation ($M_E$) versus insulation thickness for radiative cooling and for the hybrid cooling panel stack of the system of FIG. 2A.
Figure 13A:
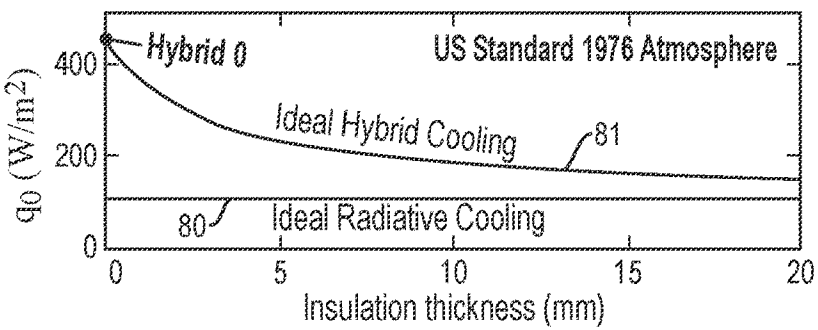
FIG. 13A is a graph showing cooling power generated at ambient temperature for radiative cooling and for the hybrid cooling panel stack of the system of FIG. 2A.

In FIG. 13A, $q_0$ is plotted as a function of the insulation 32 thickness for pure radiative cooling, illustrated as line 80, and hybrid cooling, illustrated as line 81, with ideal materials. More specifically, the radiative cooler was assumed to have an ideal broadband emitter which was also used as the reflector 24 in FIG. 2A (and/or the respective reflectors 24', 24" of FIGS. 2B and 2C). A 1 mm water film served as the evaporative layer 28 in the hybrid design and the insulation layer 32 was assumed to have total solar reflectance, IR transmittance, and the same thermal conductivity and vapor diffusivity as static air. Note that cooling designs with and without the top insulation layer (denoted as Hybrid 1 and Hybrid 0, respectively) can both achieve heat removal via simultaneous thermal radiation and evaporation from the water-rich layer 28 (Hybrid 0 is shown as the point to the far left on lines 81, 84 of FIGS. 13A and 13B, respectively). As a reference ambient condition, we used $T_{amb}$=30° C., RH=50%, Qsun=1000 W/m2, the heat transfer coefficient to the ambient air $h_{conv}$=10 W/m2-K, and U.S. Standard 1976 atmosphere. The inverse of the enthalpy of vaporization of water $h_{fg}$ is also plotted for reference, illustrated as line 85 in FIG. 13B.

The hybrid cooling panel stack 12 exhibits higher cooling power than pure radiative cooling although thicker insulation layers 32 tend to decrease $q_0$ of the hybrid design due to the added vapor mass transfer resistance in the insulation layer 32. For pure radiative cooling, the ambient cooling power $q_0$ varies little with increased PEA thickness since the overall IR emittance becomes lower while the overall solar reflectance becomes higher. For the hybrid cooling stack, as the PEA thickness increases, the vapor transport resistance for evaporation becomes significantly larger, resulting in a lower $q_0$. Nevertheless, hybrid cooling stack still has a significantly larger $q_0$ than pure radiative cooling.

The water mass flux leaving the system $\dot{m}''$ for the two cooling methods can also be considered. The water usage per cooling power generation can be defined as $M_E=\dot{m}''/q_0$. In FIG. 13B, the $M_E$ for hybrid cooling, illustrated as line 83, is larger than pure radiative cooling, which simply does not consume water, as shown by line 84. Nevertheless, it is significantly smaller than the inverse of $h_{fg}$, the enthalpy of vaporization of water at 20° C., illustrated as line 85, which would be the $M_E$ for pure evaporative cooling without solar absorption.

Also, increasing the insulation layer 32 thickness can further cut the water expenditure of hybrid cooling per cooling power generation. The insulation layer 32 improves solar reflectance and resists parasitic heat gain (which becomes more useful for materials of practical optical properties and subambient temperature operation) but adds finite resistance to vapor and IR transmission. As such, this insulation layer 32 thickness can be tuned to meet specific requirements of water consumption and cooling performance. Overall, the hybrid design has the potential to achieve higher cooling power than pure radiative cooling systems while consuming less water than pure evaporative systems per cooling power generation.

Figure 14A:
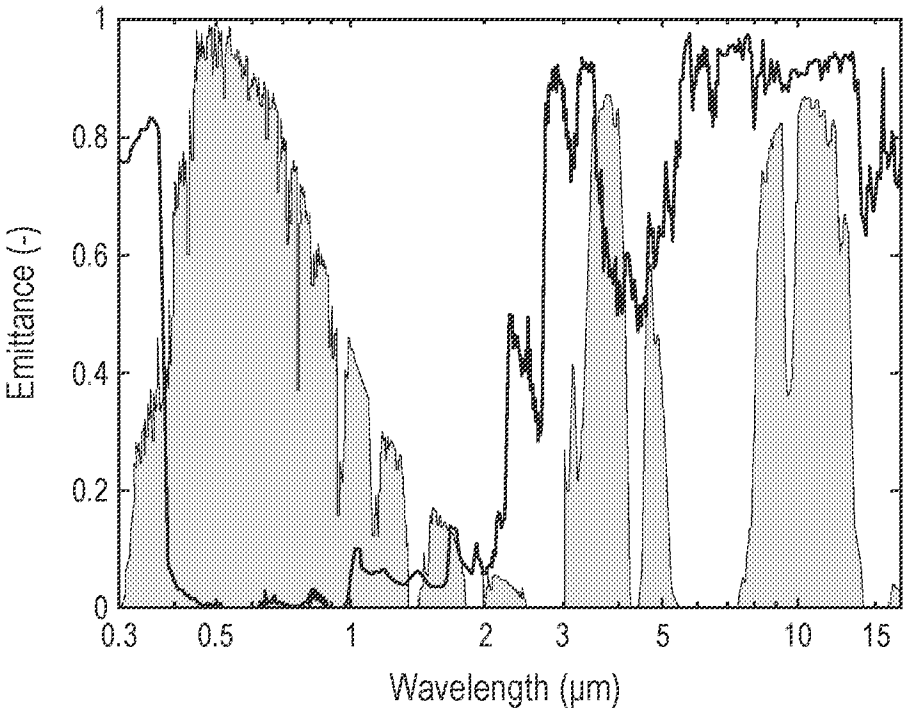
FIG. 14A is a graph of emittance versus wavelength of a 3M Enhanced Specular Reflector film of an exemplary reflector layer of the hybrid cooling panel stack of the system of FIG. 2A.
Figure 14B:
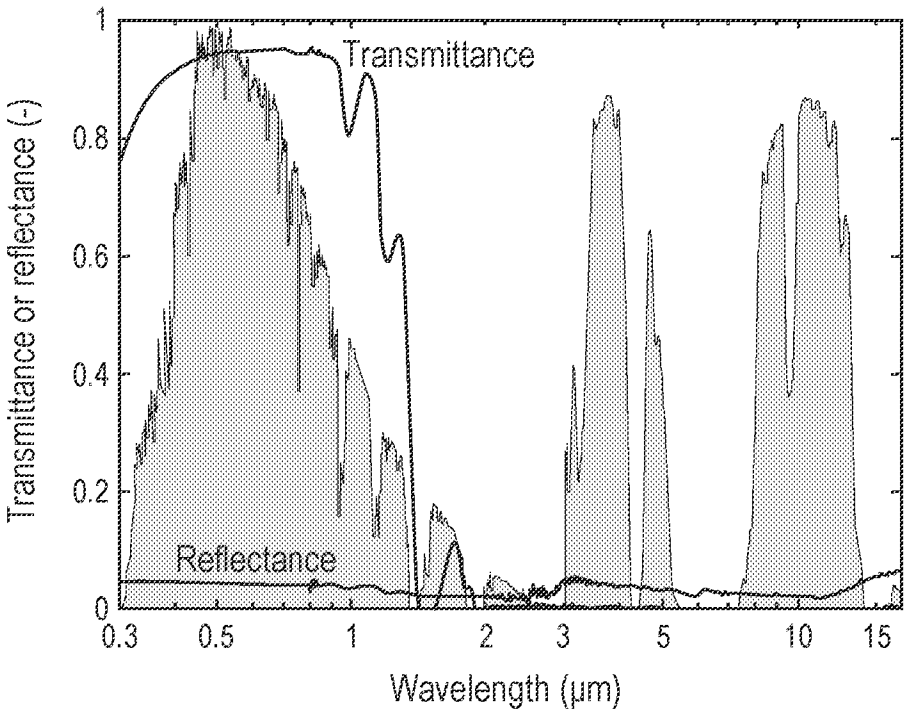
FIG. 14B is a graph of transmittance or reflectance versus wavelength of a polyacrylamide hydrogel (PAH) layer of an exemplary evaporative layer of the hybrid cooling panel stack of the system of FIG. 2A.
Figure 14C:
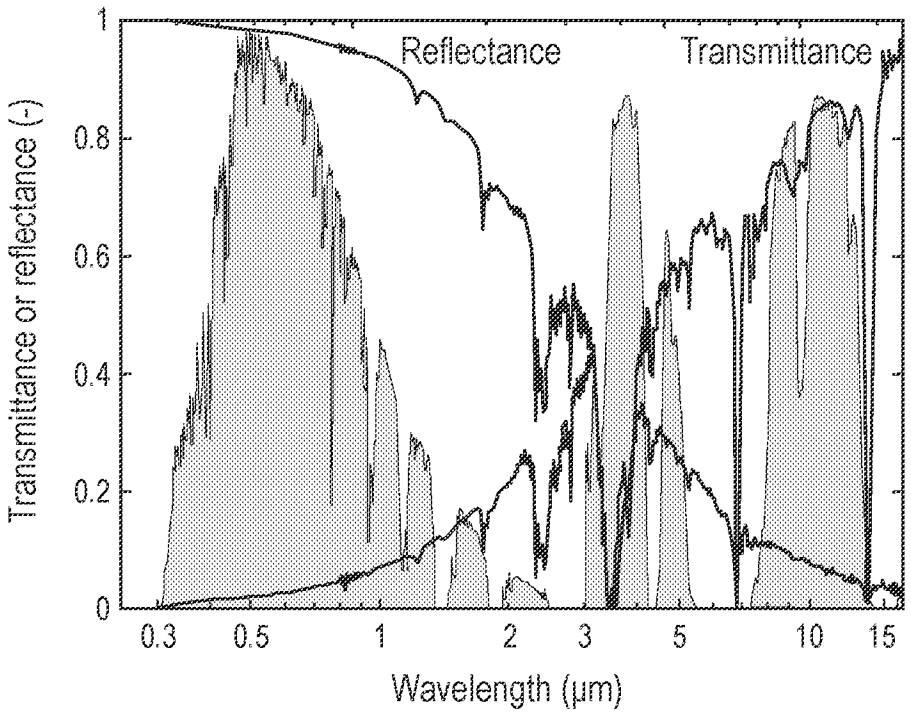
FIG. 14C is a graph of transmittance or reflectance versus wavelength of a polyethylene aerogel (PEA) layer of an exemplary evaporative layer of the hybrid cooling panel stack of the system of FIG. 2A.

In at least some embodiments, the hybrid cooling panel stack 12 can include scalable materials, including: a 3M Enhanced Specular Reflector (ESR) film, a polyacrylamide hydrogel (PAH), and a polyethylene aerogel (PEA) as the three layers 24, 28, 32 in FIG. 1 from bottom to top. The optical properties of the 3M ESR substrate are shown in FIG. 14A. The optical properties of the PAH layer 28 and the PEA layer 32 are shown in FIGS. 14B and 14C, respectively. In the exemplary embodiment described below, high transmittance and low absorption in the solar spectrum ($\alpha$solar=0.15), with very high emission in the infrared ($\varepsilon_{8\text{-}13\ \mu m}$=0.98) for an approximately 7-mm thick PAH sample. To fabricate the PAH samples, about 4.3 g of acrylamide (A8887, Sigma Aldrich) and about 20 mL deionized (DI) water were mixed to form the monomer solution for PAH synthesis. About 320 μL 0.4 wt. % solution of N,N'-Methylenebisacrylamide (146072, Sigma Aldrich) in DI water was used as the crosslinker. About 320 μL. 5 wt. % solution of ammonium persulfate (A3678, Sigma Aldrich) was used as the reaction initiator. About 40 μL N,N,N',N'-Tetramethylethylenediamine (T9281, Sigma Aldrich) was used as the reaction accelerator. The crosslinker solution, the initiator solution, and the accelerator solution were added to the monomer solution and quickly put the mixture into a mold. The mold was placed in an UV oven (Spectrolinker™ UV Crosslinker, Spectronics) for an hour to obtain PAH which was then put into excess DI water to reach the fully hydrated state.

To fabricate the PEA samples, about 0.5 wt % ultrahigh-molecular-weight polyethylene (429015, Sigma-Aldrich) was mixed with about 99.3 wt % paraffin oil (76235, Sigma-Aldrich) and about 0.2 wt % butylated hydroxytoluene (W218405, Sigma-Aldrich) in a sealed beaker at room temperature. The heterogeneous solution was then mixed in a silicone oil bath at about 160° C. and stirred with a magnetic bar for around about 30 minutes, at which point the polymer fully dissolved into the paraffin oil to create a homogeneous solution. The solution was then poured into an aluminum mold, which was subsequently submerged in cold water (about 4° C.). After phase separation of the polymer from the solvent, the gel was transferred to a hexane bath for solvent exchange. Three solvent exchanges in hexane followed by three solvent exchanges in ethanol were done over the course of two weeks to remove all paraffin oil from the polymer gel before drying. Finally, the polymer gel was dried in a supercritical $CO_2$ dryer.

In some embodiments, the 3M ESR has a solar reflectance of about 94.6%, the PAH has an about 92% water mass fraction when fully hydrated, the PEA has a solar reflectance of about 92.2% and a mid-IR transmittance of about 79.9% at about six (6) mm thickness, and the thermal conductivity and the vapor diffusivity for PEA are about 28 mW/m-K and about 0.18 $cm^2$/K, respectively.

Figure 15B:
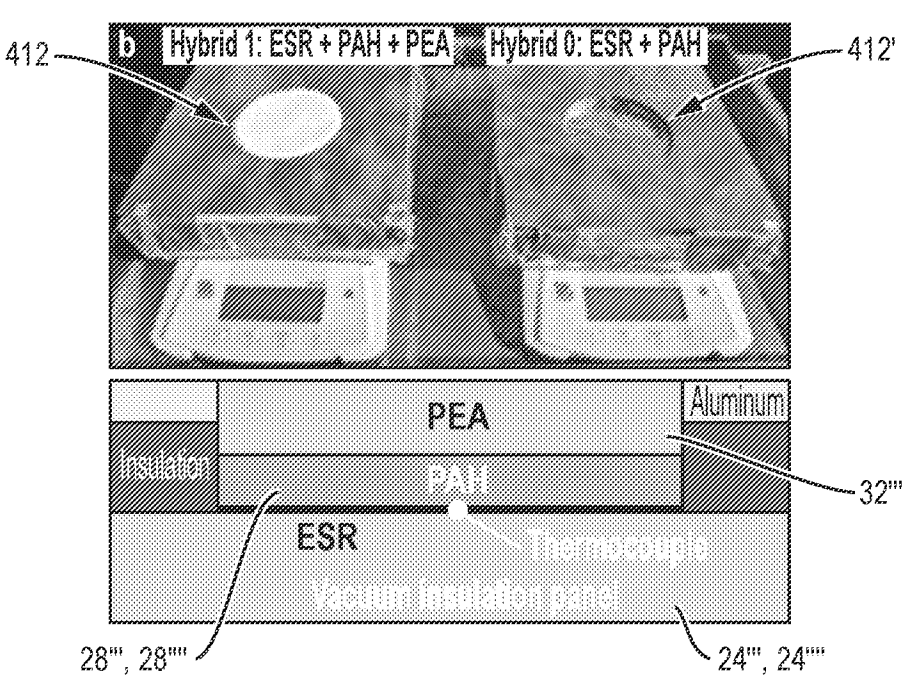
FIG. 15B is a perspective view and a schematic view of an experimental setup including one sample having only a reflector layer and evaporative layer, and a second sample having a reflector layer, an evaporative layer, and an insulation layer of the exemplary hybrid cooling panel stack of FIGS. 14A-14C and 15A.
Figure 15A:
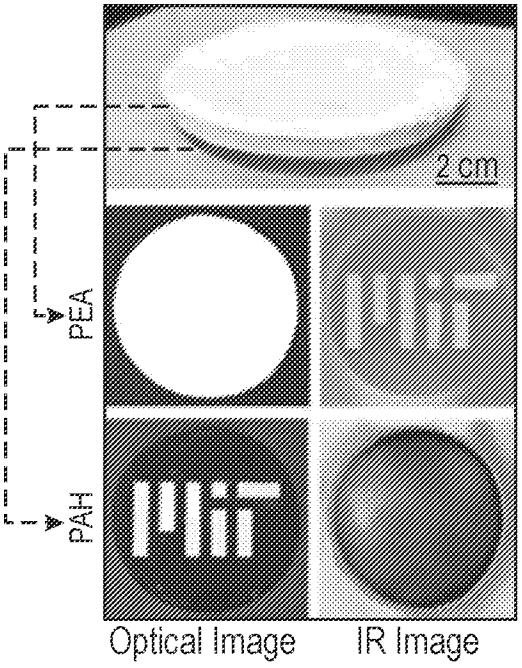
FIG. 15A illustrates optical and IR images of PAH and PEA as part of exemplary hydrogel evaporative and aerogel insulation layers of the hybrid cooling panel stack of the system of FIG. 2A.

Optical and IR images of PAH and PEA are shown in FIG. 15A. The PAH is transparent in the visible spectrum and opaque in the IR spectrum while the opposite holds for PEA. The height of the "MIT" logo is about 40 mm. The effective thermal conductivity of PEA was measured to be $k_{PEA}$=28±5 mW/m-K following the guarded-hot-plate method ASTM C1044-16 and the effective vapor diffusivity in PEA was determined as $D_{PEA}$=0.18±0.02 $cm^2$/s at about 24° C. using the wet cup method following ASTM E96. For reference, at standard temperature and pressure, the thermal conductivity of static air is about 26 mW/m-K and the vapor diffusivity in air is about 0.28 $cm^2$/s.

The stagnation temperature test for the two cases of hybrid cooling with and without insulation (Hybrid 1, shown as reference numeral 412 in FIG. 15B, and Hybrid 0, shown as reference numeral 412' in FIG. 15B), where below-the-wet-bulb temperatures are demonstrated under direct sunlight. In FIG. 15B, two identical experimental setups were placed next to each other on the roof of a building in Cambridge, Massachusetts, USA: one stack 412 contained a 3M ESR film 24", a PAH layer 28", and a PEA layer 32" (Hybrid 1) while the other stack 412' had a 3M ESR film 24" and a PAH layer 28" without the PEA insulation (Hybrid 0). The diameter of the samples is about 10 centimeters.

Figure 15C:
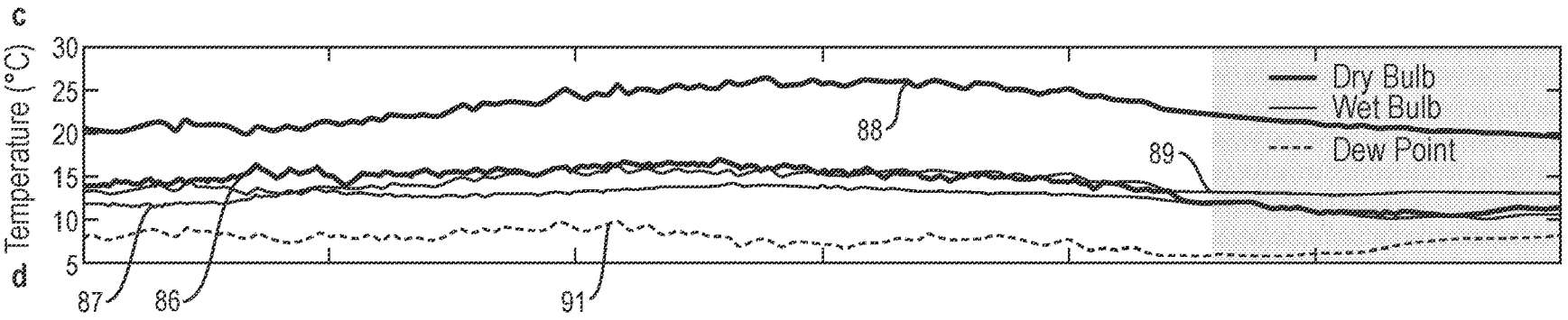
FIG. 15C is a graph showing a stagnation temperature profile of the stacks of the experimental setup of FIG. 15B.
Figure 15D:
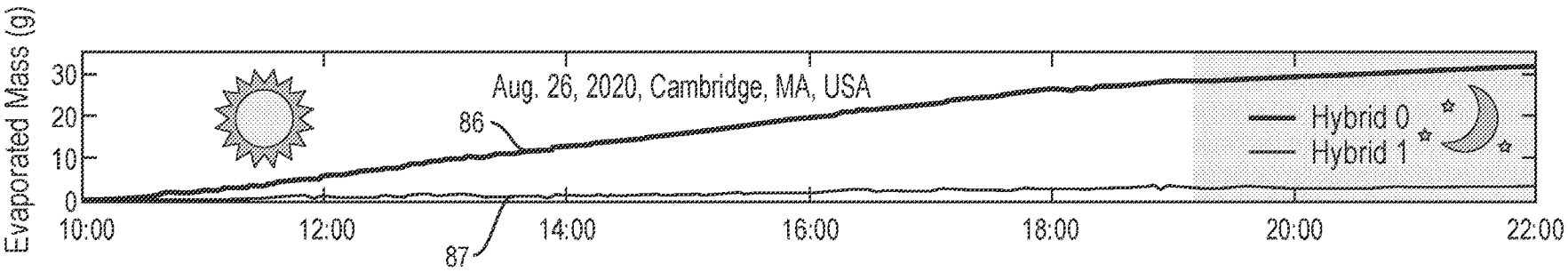
FIG. 15D is a graph showing an evaporated water mass of the stacks of the experimental setup of FIG. 15B.
Figure 15E:
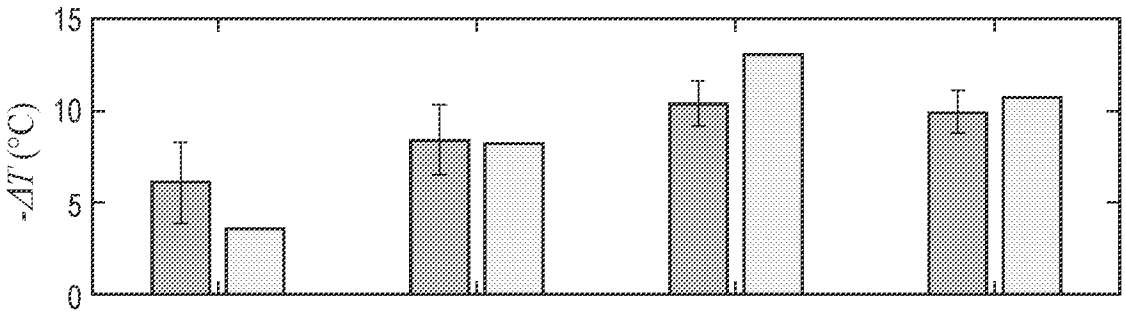
FIG. 15E is a graph showing a comparison between $-\Delta T$ values for experimental results and modeling results of the stacks of the experimental setup of FIG. 15B.
Figure 15F:
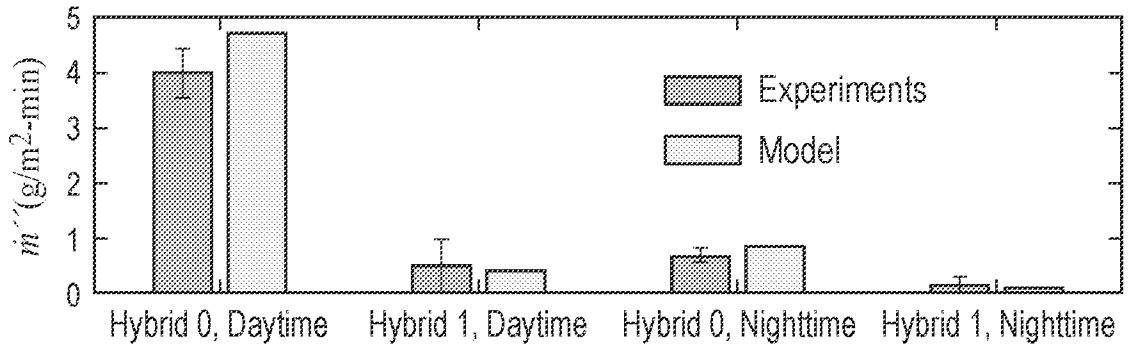
FIG. 15F is a graph showing a comparison between evaporation mass flux values for experimental results and modeling results of the stacks of the experimental setup of FIG. 15B.

As shown in FIG. 15C, the temperature of the Hybrid 0 sample, illustrated as line 86, the Hybrid 1 sample, illustrated as line 87, and the ambient, illustrated as line 88, as well as the wet-bulb temperature, illustrated as line 89, and the dew point, illustrated as line 91, recorded between 10:00 and 22:00 on Aug. 26, 2020. Leveraging simultaneous net radiation and vapor outflow, temperatures significantly below the ambient for both samples were achieved. Hybrid 1 (line 87) even stayed under the wet-bulb temperature, which is not possible with pure evaporative cooling. In the daytime, the temperature of the Hybrid 1 sample was approximately in the range of about 2° C. to about 3° C. lower than the Hybrid 0 (line 86) sample as the PAH still absorbs a non-negligible amount of solar energy without protection from the solar-reflecting PEA layer 32. At night when Qsun=0, this temperature difference becomes minimal. Also plotted are the evaporated water mass as a function of time for the two samples, as shown in FIG. 15D. Adding the PEA caused evaporation of the Hybrid 1 sample to be significantly slower, which will normally cause higher sample temperatures. However, since PEA resists parasitic and solar heating, the Hybrid 1 sample, shown as line 87 in this illustration as well, reached lower stagnation temperatures even with much less water consumption. With the Hybrid 1 sample, a stagnation temperature drop of about 9.3° C. for $T_{amb}$=about 22.2° C. and RH=about 39.5% under solar radiation Qsun=about 836 W/m$^2$ was demonstrated. To compare the experimental results with model predictions, the data for both setups during the daytime (11:30-13:00) and the nighttime (20:00-21:00) were averaged, separately, which generates four different cases, as shown in FIGS. 15E and 15F. FIGS. 15E and 15F show a comparison of $-\Delta T$ (FIG. 15E) and evaporation mass flux $\dot{m}''$ (FIG. 15F) for four different cases between experimental (left bar of each pair of bars) and modeling (right bar of each pair of bars) results. Good agreement is shown between the model and experiments for all cases in terms of both $-\Delta T$ and $\dot{m}''$.

In the exemplary assemblies of the experiments of FIGS. 15A-15F, the dimensions, in particular the thickness, of the PAH evaporative layer 28 and the PEA aerogel layer 32 are shown in the following Table 1:

TABLE 1

PAH and PEA Thicknesses for Stagnation Temperature Tests of FIGS. 15A-15E

| | System | Thickness (mm) PAH | Thickness (mm) PEA |
|---|---|---|---|
| Daytime | ESR + PAH + PEA | 7.4 | 7.6 |
| | ESR + PAH | 7.3 | — |

Figures 16A, 16B, 16C, 16D:
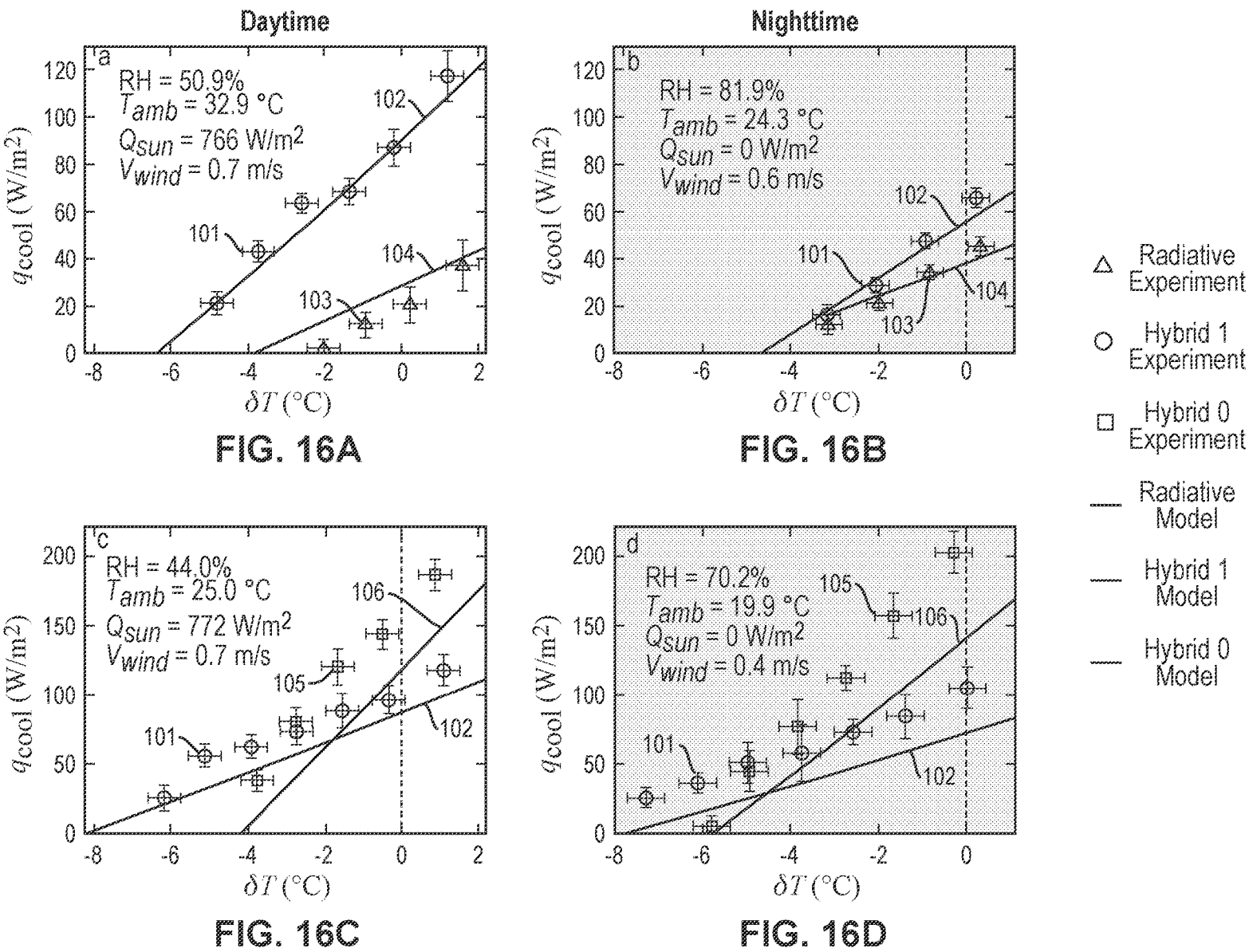
FIG. 16A is a graph showing results of an experiment conducted measuring cooling power versus ambient temperatures of the hybrid cooling panel stack of FIGS. 14A-14C and 15A and a pure radiative sample in daytime conditions.
FIG. 16B is a graph showing results of an experiment conducted measuring cooling power versus ambient temperatures of the hybrid cooling panel stack of FIGS. 14A-14C and 15A and a pure radiative sample in nighttime conditions.
FIG. 16C is a graph showing results of an experiment conducted measuring cooling power versus ambient temperatures of the hybrid cooling panel stack of FIGS. 14A-14C and 15A and a reflector layer and evaporative layer combination in daytime conditions.
FIG. 16D is a graph showing results of an experiment conducted measuring cooling power versus ambient temperatures of the hybrid cooling panel stack of FIGS. 14A-14C and 15A and a reflector layer and evaporative layer combination in nighttime conditions.

Next shown is that hybrid cooling enables large cooling power even under unfavorable climate conditions. At a low altitude test location (elevation≈22 m), the net cooling power of Hybrid 0, Hybrid 1, and a reference pure radiative cooler while varying $\delta T=T_{sub}-T_{amb}$ were characterized by embedding heaters and temperature controllers underneath the cooling layers. The first set of experiments compared the performance of Hybrid 1 (ESR layer 24'''+PAH layer 28'''+PEA layer 32''') against pure radiative cooling, as shown in FIGS. 16A and 16B, while the second set compared Hybrid 1 (ESR layer 24+PAH layer 28+PEA layer 32) and Hybrid 0 (ESR layer 24'''+PEA layer 28'''), as shown in FIGS. 16C and 16D. Each set of tests contains both a daytime and a nighttime comparison. FIGS. 16A-16D show good agreement between the experimental data and the model prediction. Although only the Hybrid 1 and Hybrid 0 experimental setups are referenced in the aforementioned figures and test results, the same test results and outcomes are applicable to the other hybrid cooling panel stacks disclosed herein (e.g., stacks 12, 12', 12", 212, 312) or otherwise derivable from the present disclosures.

FIG. 16A show significantly higher cooling power of Hybrid 1 (circles 101 show experimental data and line 102 shows model prediction) compared to pure radiative cooling (triangles 103 show experimental data and line 104 shows model prediction). Specifically, around $\delta T=0$, $q_{cool}$=about 22 W/m$^2$ was obtained for pure radiative cooling and $q_{cool}$=about 86 W/m$^2$ for Hybrid 1 with RH=about 50.9%. In FIG. 16B, the cooling power difference between Hybrid 1 and pure radiative cooling becomes less at night as evaporation was much slower with the lower $T_{amb}$ and higher RH. In FIG. 16C, around the ambient temperature with RH=about 44.0%, $q_{cool}$=about 96 W/m$^2$ for Hybrid 1 which is lower than the about 143 W/m$^2$ Hybrid 0 (circles 105 show experimental data and line 106 shows model prediction). This is due, at least in part, to the minimal parasitic heat gain when $T_{sub}$ is close to $T_{amb}$. At night, the high solar reflectance of PEA also becomes irrelevant, leading to even better relative performance of Hybrid 0 (FIG. 16D).

FIG. 16D shows that at approximately $\delta T=0$, a cooling power of about 202 W/m$^2$ for Hybrid 0 and about 105 W/m$^2$ for Hybrid 1 with RH=about 70.2% was obtained. FIG. 16D also shows that the low thermal conductivity of PEA can still help the system maintain a higher $q_{cool}$ when $T_{sub}$ is sufficiently below the ambient. Further, if the solar reflectance of the reflector is not high enough, the PEA layer 32 also becomes essential for mitigation of solar heating. For example, when replacing the ESR substrate 24 (0.95 solar reflectance) with a white paint (ColorMaster™ Paint+Primer White) surface with only 0.77 solar reflectance, the Hybrid 1 design shows consistently better cooling performance for subambient-to-ambient temperatures than the Hybrid 0 design due to the additional solar reflectance provided by PEA. With the PEA layer 32, the performance of the hybrid cooling layers is much less sensitive to the optical properties of the substrate.

In the exemplary assemblies of the experiments of FIGS. 16A-16D, the dimensions, in particular the thickness, of the PAH evaporative layer 28 and the PEA aerogel layer 32 for each scenario (FIGS. 16A-16D) are shown in the following Table 2:

TABLE 2

PAH and PEA Thicknesses for Cooling Power Experiments of FIGS. 16A-16D

| | System | Thickness (mm) PAH | Thickness (mm) PEA |
|---|---|---|---|
| Daytime | ESR + PAH + PEA | 5.0 | 6.0 |
| | ESR + PEA | — | 5.4 |
| Nighttime | ESR + PAH + PEA | 5.0 | 6.0 |
| | ESR + PEA | — | 5.4 |
| Daytime | ESR + PAH + PEA | 5.0 | 7.5 |
| | ESR + PAH | 5.0 | — |
| Nighttime | ESR + PAH + PEA | 5.0 | 7.5 |
| | ESR + PAH | 3.0 | — |

Free Cooling

Figure 17:
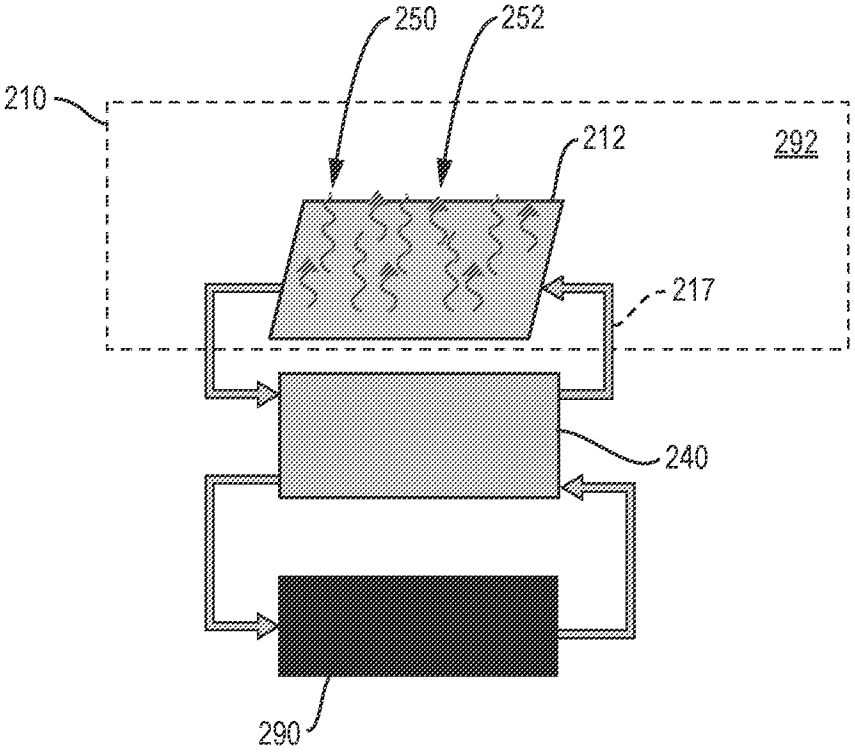
FIG. 17 is a schematic view of a hybrid evaporative and radiative cooling panel system according to a further aspect of the present disclosure, showing that the system can operate in a free cooling mode with a heat exchanger.

Another embodiment of a ERCP system 210 is shown in FIG. 17. The ERCP system 210 is similar to the ERCP system 10, and other ERCP systems (e.g., the systems 10', 10") described herein. Accordingly, similar reference numbers in the 200 series indicate features that are common between the ERCP system 210 and the ERCP system 10. The description of the ERCP system 10 is incorporated by reference to apply to the ERCP system 210, except in instances when it conflicts with the specific description and the drawings of the ERCP system 210.

Hybrid evaporative and radiative cooling panels, such as a cooling panel stack 212 of the ERCP 210 described in this exemplary embodiment, can also work in a free cooling mode (i.e., not connected to a vapor compression system). In some industries, for example but not limited to data center cooling, vapor compression systems are not always required and free cooling with the ambient air can often be sufficient. In data center cooling, free cooling may be sufficient to maintain the server at their target operating temperature. But while free cooling can help achieve significant energy savings in data centers compared to vapor-compression-only cooling, free cooling is typically only possible when the ambient dry-bulb or wet-bulb temperatures are low enough, limiting its use to only a limited number of hours annually or to colder regions. By using hybrid cooling panels, such as the cooling panel stack 212 of the ERCP 210 and/or other stacks disclosed herein and/or derivable from the present disclosures, it would be possible to extend the range of operating ambient temperatures to further extend the operating hours of free cooling, thus cutting down on energy consumption while also enabling free cooling in warmer climates and lower water consumption compared to evaporating.

In the exemplary embodiment, the cooling panel stacks 212 can provide the necessary cooling to the building through a heat exchanger 240. A person skilled in the art will appreciate various types and configurations of heat exchangers, and thus a further description of the configuration of the heat exchanger 240 and how it operates is unnecessary. The cooling panel stacks 212 may be arranged on the roof 292 of the a building 290, or in any suitable location known to a person skilled in the art. A hot heat transfer fluid 217 can flow at the backside of the disclosed hybrid cooling panel stack 212, as shown in FIG. 17, thereby rejecting its heat to the colder panel 212 and decreasing in temperature. After exiting the panel stack 212, the cold heat transfer fluid 217 can be directed to the heat exchanger 240 (indoor and/or outdoor of a building 290) where it can exchange heat with the hot air from the building 290. The heat exchange with the hot air can be done by directly flowing air on top of heat transfer fluid cold tubes or coils, or through a secondary heat transfer fluid. In some embodiments, the heat exchange with the hot air can include a heat exchanger between the heat transfer fluid and the air. Using this process, the building 290 hot air can get cooled up to the heat exchanger inlet temperature of the heat transfer fluid 217 coming from the hybrid cooling panel stack 212. This cold air can be used, by way of non-limiting example, for space cooling in the building 290.

Commercial applications provided for by the present disclosures can include targeting to address the air conditioning and/or refrigeration systems of commercial buildings such as datacenters and supermarkets. In one instance, a simulation was run using MATLAB to calculate the baseline capabilities of systems of the present disclosure in use with a refrigeration cycle. More particularly, in MATLAB, first calculated is the baseline system (no evaporative-radiative cooling) hourly electricity consumption. Assumed is that the refrigeration cycle uses R-407A refrigerant with a fixed evaporator temperature of −2° C., a compressor isentropic efficiency of 70%, a pressure drop of 1% across the condenser and evaporator, and an air-cooled condenser operating at a temperature of 10 K above the ambient temperature with a power consumption of 20 $W_{electric}$ per 1000 $W_{thermal}$ rejected to the ambient. The thermodynamic properties of the refrigerant are obtained from CoolProp. The total energy consumption for the baseline system, calculated on an hourly basis, accounts for the compressor work and the air-cooled condenser fan power. For the hybrid evaporative-radiative cooling approach, the same solar reflector 24, hydrogel layer 28, and PEA insulation layer 32 as described above is used, and the proportion of the rooftop area covered by the panels depending on the simulation is varied. Also assumed is that a 15% ethylene glycol-water solution of heat transfer fluid 17 flows at the backside of the cooling panel stack 12 in a parallel flow configuration. The hybrid cooling panel stack's 12 fluid loop is also connected to a heat exchanger 40 with the R-407A refrigerant in series (after) with the air-cooled condenser 94. Depending on the operating mode, the air-cooled condenser 94 either desuperheats (fully or partly down to a temperature of 10 K above the ambient) the refrigerant (and/or other material(s) that may be disposed in the condenser 94) after compression (while the hybrid cooling panels 12 perform the rest of the refrigerant cooling) or cool the refrigerant down to a saturated liquid state (before subcooling the refrigerant with the hybrid cooling panels 12). For simplicity, it is assumed that the heat exchanger 40 between the cooling panel 12 heat transfer fluid 17 and the refrigerant operates in a counterflow configuration with an effectiveness of unity.

Using the hybrid cooling panels minimizes the air-cooled condenser fan power while enabling lower condenser temperatures than the baseline system and thus lower compressor work. These energy savings are however counterbalanced by the pumping energy required to flow the ethylene glycol-water fluid at the backside of the hybrid cooling panels such that an optimal mass flow rate must be solved for at each hour. More specifically, a higher fluid mass flow rate will maximize the average temperature of the hybrid cooling panels and thus their total heat rejection rate but will also require a higher pumping power, and vice versa. In the disclosed model, the total energy consumption (sum of compressor work, air-cooled condenser fan work and fluid loop pumping work) is optimized by varying the condenser temperature and the fluid loop mass flow rate at each hour. The average hourly cooling power of the hybrid cooling panels is calculated from hourly weather data (e.g., ambient temperature, solar irradiance, relative humidity, precipitable water vapor, polyethylene aerogel insulation thickness, wind speed and cloud coverage) and using the average ethylene glycol-water fluid temperature. The yearly energy consumption is summed from the hourly results and energy savings are derived using the baseline system as the reference.

This modeling framework can also be used to evaluate the yearly energy and water consumption of traditional evaporative condensers. More specifically, it is assumed that the evaporative condensers can provide a condensation temperature approximately in the range of about 5° F. to about 15° F. above the wet-bulb temperature and that they operate with a bleed rate of one-quarter the evaporation rate (we assume an equivalent bleed rate for our hybrid cooling panels).

It was determined that the present disclosures allow for a reduction in water consumption, such reductions being more pronounced than others, depending on various weather conditions in regions of the country (and world). More particularly, it was observed that a 76% to 95% reduction in water consumption is observed across the different climate zones for the hybrid cooling panels, a promising number for reducing space cooling related water usage, especially in water-scarce regions. This reduction in water consumption can be attributed to a few factors. First, the hybrid nature of the cooling architecture means that a large portion of the cooling is done by radiative cooling, which does not consume water. Second, the cooling panels are in series with an air-cooled condenser which contributes to a portion of the heat rejection. Third, the hybrid cooling panels sometimes operate above the ambient temperature (although at a lower temperature than the air-cooled condenser) and can thus benefit from natural or forced convective cooling. Overall, it has been demonstrated that important refrigeration-related electricity savings are possible in supermarkets across the United States using rooftop hybrid cooling panels, while also using much less water than evaporative condensers. Further improvements can be shown by changing the coverage rooftop panels provide. In some modeling, the hybrid cooling panels coverage was fixed to 10% of the total rooftop surface area for the sake of simplicity. Changing the rooftop panel coverage can however help optimize energy savings, water consumption and the payback period.

The hybrid panels provided for herein can be recharged with water. Assuming 5-mm PAH and 10-mm PEA, the recharging period for the hybrid cooling panel stack in most places is typically greater than 10 days and can surpass a month for counties on the west coast. Even for hot and arid areas, one working cycle for the hybrid cooling panel stack can last around four days. The recharging period of the hybrid cooling panel stack can also be increased with thicker PAH and PEA designs, which improve the water capacity and insulation. To recharge the hybrid cooling panel stack structure, the hydrogel layer is taken out and soaked it in water, and e a second fully hydrated hydrogel layer to minimize downtime and allow for alternation may be used. To keep the materials in place during the recharging process, extended parts for the hydrogel layer that can be dipped into water reservoirs can be designed. Capillary pumping can be used to route water into the dried hydrogel, leveraging its porous structure.

In further advantageous usage scenarios, the improved hybrid cooling panel stack 12 may be utilized for food storage applications. Around one third of the food produced on earth is being wasted. In developing countries, over 15% of post-harvest food is being lost because of inadequate handling and storage, accentuating food insecurity, reducing farmer's income and depleting natural resources while causing unnecessary greenhouse gases emissions. With earth's increasing population and related consumption, demand on agriculture, energy and natural resources is hitting record highs and must urgently be addressed. Solving this complex problem will require many different types of solutions, ranging from improved food production, environmental performance and resilience, to better data and decision support tools that guide management decisions, to simple solutions improving the food supply chains and customer behavior.

One approach to improving the food chain is to improve the cold chain starting right at the post-harvest. Several works in the literature propose ideal storage temperatures and humidity conditions for various food produce as well as their temperature dependent lifetime. In fact, the storage temperature for sensitive products such as perishable foods can have a drastic effect on produce lifetime. The rate of quality decay can increase by 2-3× for every 10° C. in temperature increase. Even a small decrease in average or maximum temperature can have significant effects on post-harvest losses. With that in mind, the use of clay pot passive evaporative coolers can reduce post-harvest food waste, for example in climates such as in sub-Saharan Africa. By storing post-harvest fruit and vegetables inside clay pots coolers, a decrease in the average daily temperature by approximately in the range of about 1° C. to about 3° C., with an approximate range of about 7° C. to about 15° C. lower peak daily temperature and a reduction in temperature fluctuations approximately in the range of about 10° C. to about 20° C. can be achieved. As a result, the controlled environment can enable shelf-life improvements of specific vegetables ranging from about 2× to about 4× compared to other vegetables stored at ambient temperature. While the evaporative cooler provides significant benefits to the users, the system still suffers from critical challenges. First, the evaporative cooler suffers from environmental heat gain as its temperature drop below the ambient dry bulb temperature. Second, the evaporative cooler requires frequent watering due to the large evaporation rate of water. Third, the evaporative coolers have poor solar reflectivity, leading to undesired solar heating or requiring the construction of a large shade cover.

Figure 18:
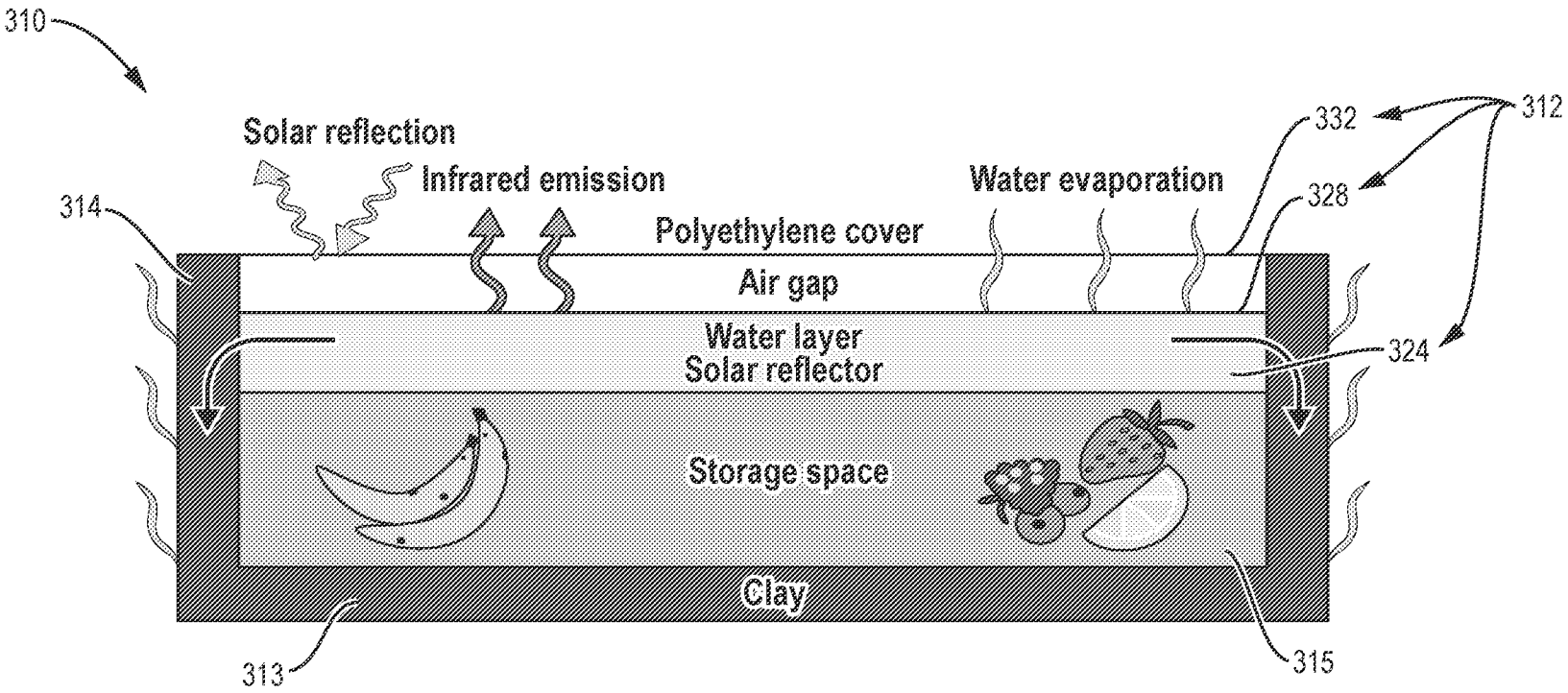
FIG. 18 is a hybrid evaporative-radiative cooler for storage of food produce according to a further aspect of the present disclosure.

To tackle these limitations, the disclosed hybrid cooling panel stack architecture provides passive cooling of food produce at low sub-ambient temperatures, with lower water consumption and without shade cover. According to another aspect of the present disclosure, a hybrid passive cooler 310 having a cooling stack 312 for food produce is presented in FIG. 18. By way of non-limiting embodiment, a clay container 313 having side walls 314 can be used to store fruit and vegetables in a storage space 315. A lid made of a solar reflector 324, a water layer (evaporative layer 328), and a polyethylene cover (insulation layer 332) provides both radiative and evaporative cooling, operating in similar fashions as other stacks described herein. As shown, infrared remission, water evaporation, and solar reflection can occur in similar fashions as provided for herein. The water can also wick into the clay container 313 to evaporate on the side walls 314. The fabrication and implementation of a hybrid cooler for food produce can have a significant impact in developing countries which currently lack proper refrigerated storage facilities.

Examples of the above-described embodiments can include the following:

1. A cooling panel, comprising:
   a reflector layer; and
   an evaporative and infrared-emitting layer;
   wherein the cooling panel is configured to be in fluid communication with a heat exchanger, and
   wherein the cooling panel is further configured to cool a heat transfer fluid by way of both evaporative cooling and radiative cooling, the cooling panel also being configured such that the heat transfer fluid passes at least one of through or across the cooling panel and flows to the heat exchanger.
2. The cooling panel of example 1, wherein the reflector layer comprises a solar-reflecting material.
3. The cooling panel of example 2, wherein the solar-reflecting material comprises at least one of white paint, metallic film, a porous polymeric layer, a metamaterial layer, or a multilayer polymeric film.
4. The cooling panel of any of examples 1 to 3, wherein the solar-reflecting material is a 3M Enhanced Specular Reflector (ESR) film.
5. The cooling panel of any of examples 1 to 4, wherein the evaporative and infrared-emitting layer comprises a solar-transparent material.

6. The cooling panel of example 5, wherein the solar-transparent material comprises at least one of a hydrogel or water.
7. The cooling panel of example 6, wherein the hydrogel comprises a polyacrylamide hydrogel.
8. The cooling panel of example 6 or example 7, wherein the hydrogel comprises free radical copolymerization of acrylamide and 2 acrylamido 2 methylpropan sulfonic acid.
9. The cooling panel of any of examples 1 to 8, wherein the heat transfer fluid that passes at least one of through or across the cooling panel flows at least one of through or across the evaporative and infrared-emitting layer.
10. The cooling panel of example 9, wherein the evaporative and infrared-emitting layer comprises the heat transfer fluid.
11. The cooling panel of example 9 or example 10, wherein the evaporative and infrared-emitting layer is configured to receive the heat transfer fluid such that at least a portion of the heat transfer fluid is supplied from outside of the evaporative and infrared-emitting layer.
12. The cooling panel of any of examples 9 to 11, wherein an entirety of the heat transfer fluid flowing through the cooling panel flows at least one of through or across the evaporative and infrared-emitting layer.
13. The cooling panel of any of examples 9 to 12, wherein the evaporative and infrared-emitting layer comprises at least one of water, a water film, or an infrared-emitting material flowing therethrough.
14. The cooling panel of any of examples 1 to 13, wherein the reflector layer and the evaporative and infrared-emitting layer are formed as an integrated, single layer.
15. The cooling panel of any of examples 1 to 14, further comprising:
    a heat transfer fluid layer,
    wherein the reflector layer is disposed above the heat transfer fluid layer,
    wherein the evaporative and infrared-emitting layer is disposed above the reflector layer,
    wherein the heat transfer fluid layer is configured to be in fluid communication with the heat exchanger, and
    wherein the cooling panel is further configured to cool the heat transfer fluid that passes at least one of through or across the heat transfer fluid layer and flows to the heat exchanger.
16. The cooling panel of example 15, wherein the heat transfer fluid layer, the reflector layer, and the evaporative and infrared-emitting layer are formed as an integrated, single layer.
17. The cooling panel of example 15 or example 16, wherein an entirety of the heat transfer fluid flowing through the cooling panel flows at least one of through or across the heat transfer fluid.
18. The cooling panel of example 15 or example 16, wherein a first portion of the heat transfer fluid flowing through the cooling panel flows at least one of through or across the evaporative and infrared-emitting layer and a second portion of the heat transfer fluid flowing through the cooling panel flows at least one of through or across the heat transfer fluid layer.
19. The cooling panel of any of examples 1 to 18, further comprising:
    an insulation layer disposed above the evaporative layer.
20. The cooling panel of example 19, wherein the insulation layer comprises a vapor-permeable, infrared-transparent, and solar-reflecting material.
21. The cooling panel of example 20, wherein the insulation layer has total solar reflectance and total IR transmittance.
22. The cooling panel of example 20 or example 21, wherein the vapor-permeable, infrared-transparent, and solar-reflecting material comprises at least one of polyethylene aerogel, porous polyethylene, or polyethylene fabric.
23. The cooling panel of any of examples 20 to 22, wherein the insulation layer comprises 08-052 gel, HiwowSport.
24 The cooling panel of any of examples 20 to 23, wherein the insulation layer and the evaporative and infrared-emitting layer are formed as an integrated, single layer.
25. The cooling panel of any of examples 20 to 24, wherein the insulation layer has a thickness as measured from a top surface to a bottom surface of the insulation layer that is greater than a thickness of the evaporative and infrared-emitting layer as measured from a top surface to a bottom surface of the evaporative and infrared-emitting layer.
26. A method of cooling, comprising:
    causing a heat transfer fluid to pass at least one of across or through a cooling panel;
    cooling the heat transfer fluid both by evaporative cooling and radiative cooling while the heat transfer fluid passes at least one of across or through the cooling panel; and
    directing the cooled heat transfer fluid to a condenser to at least one of desuperheat a material disposed in the condenser, sub-cool the condenser, or lower a temperature of the condenser.
27. The method of example 26, wherein the cooling panel comprises the cooling panel of any of examples 1 to 25.
28. The method of example 26 or example 27, wherein causing a heat transfer fluid to pass at least one of across or through a cooling panel further comprises operating a pump to circulate the heat transfer fluid between the cooling panel and the condenser.
29. The method of any of examples 26 to 28, wherein cooling the heat transfer fluid by evaporative cooling and radiative cooling further comprises:
    dissipating heat from the heat transfer fluid by thermal radiation; and
    dissipating heat from the heat transfer fluid by water evaporation.
30. The method of any of examples 26 to 29, further comprising:
    carrying out the cooling the heat transfer fluid both by evaporative cooling and radiative cooling while the heat transfer fluid passes at least one of across or through the cooling panel via the evaporative and infrared-emitting layer and the reflector layer of the cooling panel.
31. The method of example 30, wherein the cooling of the heat transfer fluid both by evaporative cooling and radiative cooling includes emitting thermal radiation from the evaporative and infrared-emitting layer.
32. The method of example 30 or example 31, wherein the cooling of the heat transfer fluid both by evaporative cooling and radiative cooling includes evaporating fluid from the evaporative and infrared-emitting layer.
33. The method of any of examples 30 to 32, further comprising:
    carrying out the cooling the heat transfer fluid both by evaporative cooling and radiative cooling while the heat transfer fluid passes at least one of across or through the cooling panel via the insulation layer.

34. The method of example 33, wherein the cooling of the heat transfer fluid both by evaporative cooling and radiative cooling further includes reflecting solar energy off of the insulation layer.

35. The method of any of example 33 or example 34, wherein the cooling of the heat transfer fluid both by evaporative cooling and radiative cooling further includes allowing at least some of the emitted thermal radiation from the evaporative and infrared-emitting layer and the evaporated fluid from the evaporative and infrared-emitting layer to pass through the insulation layer.

36. The method of any of examples 26 to 35, wherein the condenser is at least one of part of an air conditioner, part of a refrigerator, disposed on a building, or disposed in a field.

37. The method of any of examples 26 to 36, wherein an entirety of the heat transfer fluid to be cooled is provided to the cooling panel by the condenser.

38. The method of any of examples 26 to 36, wherein a first portion of the heat transfer fluid to be cooled is provided to the cooling panel by the condenser and a second portion of the heat transfer fluid to be cooled is provided to the cooling panel by a second fluid source different than the condenser.

39. The method of any of examples 26 to 38, wherein a heat exchanger of the condenser is part of a free cooling cycle in which the heat exchanger is in fluid communication with hot air from a building.

40. The method of example 39, wherein at least one of:

the hot air from the building is directed on top of at least one of a conduit or a coil through which the cooled heat transfer fluid flows, or the hot air from the building is directed to a secondary heat transfer fluid that is in fluid communication with the cooled heat transfer fluid.

41. The method of any of examples 26 to 40, wherein directing the cooled heat transfer fluid to a condenser is done by a heat exchanger.

42. The method of any of examples 26 to 41, further comprising:

recirculating the heat transfer fluid into the cooling panel after having passed through the condenser.

43. The method of any of examples 26 to 42, further comprising:

outputting a first portion of the heat transfer fluid to the condenser from the heat exchanger and outputting a second portion of the heat transfer fluid to the cooling panel from the heat exchanger.

44. The method of any of examples 26 to 43, further comprising:

directing the heat transfer fluid to the condenser after the heat transfer fluid has been directed to a heat exchanger after having passed at least one of across or through the cooling panel.

A person skilled in the art will appreciate further features and advantages of the disclosures based on the provided for descriptions and embodiments. Accordingly, the inventions are not to be limited by what has been particularly shown and described. All publications and references cited herein are expressly incorporated by reference in their entirety.

What is claimed is:

1. A cooling panel, comprising:

a reflector layer; and an evaporative and infrared-emitting layer;

wherein the cooling panel is configured to be in fluid communication with a heat exchanger, and wherein the cooling panel is further configured to cool a heat transfer fluid by way of both evaporative cooling and radiative cooling, the cooling panel also being configured such that the heat transfer fluid passes at least one of through or across the cooling panel and flows to the heat exchanger.

2. The cooling panel of claim 1, wherein the reflector layer comprises a solar-reflecting material.

3. The cooling panel of claim 1, wherein the evaporative and infrared-emitting layer comprises a solar-transparent material.

4. The cooling panel of claim 3, wherein the solar-transparent material comprises at least one of a hydrogel or water.

5. The cooling panel of claim 4, wherein the hydrogel comprises a polyacrylamide hydrogel.

6. The cooling panel of claim 1, wherein the heat transfer fluid that passes at least one of through or across the cooling panel flows at least one of through or across the evaporative and infrared-emitting layer.

7. The cooling panel of claim 6, wherein the evaporative and infrared-emitting layer comprises at least one of water, a water film, or an infrared-emitting material flowing therethrough.

8. The cooling panel of claim 1, further comprising:

a heat transfer fluid layer, wherein the reflector layer is disposed above the heat transfer fluid layer, wherein the evaporative and infrared-emitting layer is disposed above the reflector layer, wherein the heat transfer fluid layer is configured to be in fluid communication with the heat exchanger, and wherein the cooling panel is further configured to cool the heat transfer fluid that passes at least one of through or across the heat transfer fluid layer and flows to the heat exchanger.

9. The cooling panel of claim 1, further comprising:

an insulation layer disposed above the evaporative layer.

10. The cooling panel of claim 9, wherein the insulation layer comprises a vapor-permeable, infrared-transparent, and solar-reflecting material.

11. The cooling panel of claim 9, wherein the insulation layer and the evaporative and infrared-emitting layer are formed as an integrated, single layer.

12. A method of cooling, comprising:

causing a heat transfer fluid to pass at least one of across or through a cooling panel;

cooling the heat transfer fluid both by evaporative cooling and radiative cooling while the heat transfer fluid passes at least one of across or through the cooling panel; and directing the cooled heat transfer fluid to a condenser to at least one of desuperheat a material disposed in the condenser, sub-cool the condenser, or lower a temperature of the condenser.

13. The method of claim 12, wherein cooling the heat transfer fluid by evaporative cooling and radiative cooling further comprises:

dissipating heat from the heat transfer fluid by thermal radiation; and dissipating heat from the heat transfer fluid by water evaporation.

14. The method of claim 12, further comprising:

carrying out the cooling the heat transfer fluid both by evaporative cooling and radiative cooling while the heat transfer fluid passes at least one of across or through the cooling panel via the evaporative and infrared-emitting layer and the reflector layer of the cooling panel.

15. The method of claim 14, wherein the cooling of the heat transfer fluid both by evaporative cooling and radiative cooling includes emitting thermal radiation from the evaporative and infrared-emitting layer.

16. The method of claim 14, wherein the cooling of the heat transfer fluid both by evaporative cooling and radiative cooling includes evaporating fluid from the evaporative and infrared-emitting layer.

17. The method of claim 14, further comprising:

carrying out the cooling the heat transfer fluid both by evaporative cooling and radiative cooling while the heat transfer fluid passes at least one of across or through the cooling panel via the insulation layer.

18. The method of claim 17, wherein the cooling of the heat transfer fluid both by evaporative cooling and radiative cooling further includes reflecting solar energy off of the insulation layer.

19. The method of claim 17, wherein the cooling of the heat transfer fluid both by evaporative cooling and radiative cooling further includes allowing at least some of the emitted thermal radiation from the evaporative and infrared-emitting layer and the evaporated fluid from the evaporative and infrared-emitting layer to pass through the insulation layer.

20. The method of claim 14, wherein an entirety of the heat transfer fluid to be cooled is provided to the cooling panel by the condenser.

21. The method of claim 14, wherein a first portion of the heat transfer fluid to be cooled is provided to the cooling panel by the condenser and a second portion of the heat transfer fluid to be cooled is provided to the cooling panel by a second fluid source different than the condenser.

* * * * *